US011117370B2

(12) United States Patent
Sohgawa

(10) Patent No.: US 11,117,370 B2
(45) Date of Patent: Sep. 14, 2021

(54) LIQUID DISCHARGING APPARATUS AND IMAGE FORMING SYSTEM

(71) Applicant: Norimasa Sohgawa, Kanagawa (JP)

(72) Inventor: Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/556,419

(22) Filed: Aug. 30, 2019

(65) Prior Publication Data

US 2020/0101726 A1 Apr. 2, 2020

(30) Foreign Application Priority Data

Sep. 27, 2018 (JP) ..... JP2018-182693

(51) Int. Cl.
*B41J 2/045* (2006.01)
*B41J 11/00* (2006.01)

(52) U.S. Cl.
CPC ..... *B41J 2/04588* (2013.01); *B41J 2/04541* (2013.01); *B41J 2/04581* (2013.01); *B41J 2/04593* (2013.01); *B41J 11/002* (2013.01); *B41J 11/0015* (2013.01)

(58) Field of Classification Search
CPC ..... B41J 2/04588; B41J 2/04581
See application file for complete search history.

(56) References Cited

U.S. PATENT DOCUMENTS 8,845,052 B2 9/2014 Tamura et al.
2009/0289975 A1* 11/2009 Yoshida ..... B41J 2/16526 347/10
2015/0251414 A1* 9/2015 Araki ..... B41J 2/04516 347/10
2019/0202201 A1* 7/2019 Chikamoto ..... B41J 2/04541

FOREIGN PATENT DOCUMENTS

JP 2013-014121 1/2013
JP 2014-028450 2/2014
JP 2015-174401 10/2015

OTHER PUBLICATIONS

U.S. Appl. No. 16/299,267, filed Mar. 12, 2019.

* cited by examiner

*Primary Examiner* — Sharon Polk
(74) *Attorney, Agent, or Firm* — IPUSA, PLLC

(57) ABSTRACT

A liquid discharging apparatus includes a nozzle hole configured to discharge liquid; a liquid chamber provided so as to communicate with the nozzle hole; a piezoelectric element configured to change a pressure applied to the liquid in the liquid chamber to discharge the liquid from the nozzle hole; a driving waveform generation circuit configured to generate a driving waveform signal during a discharge control period having a predetermined cycle, to apply a driving waveform voltage to the piezoelectric element; a switch configured to selectively supply, to the piezoelectric element, a waveform included in the driving waveform signal; and a controller configured to perform voltage setting control for applying a predetermined voltage to the piezoelectric element, in a case where a non-discharge control period, having a predetermined cycle, causes the piezoelectric element to change by a voltage greater than or equal to an allowable voltage.

14 Claims, 15 Drawing Sheets

FIG.11 COMPARISON EXAMPLE

LIQUID DISCHARGING APPARATUS AND IMAGE FORMING SYSTEM

CROSS-REFERENCE TO RELATED APPLICATION

The present application is based on and claims priority under 35 U.S.C. § 119 to Japanese Patent Application No. 2018-182693, filed on Sep. 27, 2018, the contents of which are incorporated herein by reference in their entirety.

BACKGROUND OF THE INVENTION

1. Field of the Invention

The present invention relates to a liquid discharging apparatus and an image forming system.

2. Description of the Related Art

A recording head of an inkjet recording apparatus used as an image forming apparatus such as a printer, a facsimile machine, a copier, or a plotter, etc., includes a nozzle, a pressure generating chamber (a pressurizing liquid chamber) in communication with the nozzle, and a pressure generating element such as a piezoelectric element, etc., for discharging ink.

For example, Patent Document 1 describes that the through-down timing of the reference voltage applied to the piezoelectric element is changed according to the number of times of discharging ink by the recording head, after the scanning of the recording head, thereby reducing the variation in the polarization of the piezoelectric element, and reducing the variation of the discharging performance.

Patent Document 2 describes that a portion of the waveform of the discharge pulse applied to the piezoelectric element for discharging ink, is used to generate a non-discharge pulse by which ink is not discharged, thereby shortening the waveform length of the driving waveform generated commonly for a plurality of piezoelectric elements and increasing the efficiency of printing.

Patent Document 3 describes that in order to inhibit the heat generation of a print head caused by continuously discharging ink, a liquid droplet non-discharge period, which is longer than a liquid droplet discharge period in which pulses for discharging liquid droplets from the nozzle are generated, is provided in the driving cycle.

Patent Document 1: Japanese Unexamined Patent Application Publication No. 2013-014121

Patent Document 2: Japanese Unexamined Patent Application Publication No. 2015-174401

Patent Document 3: Japanese Unexamined Patent Application Publication No. 2014-028450

SUMMARY OF THE INVENTION

According to one aspect of the present invention, there is provided a liquid discharging apparatus including a nozzle hole (a hole of a nozzle) configured to discharge liquid; a liquid chamber provided so as to communicate with the nozzle hole; a piezoelectric element configured to change a pressure applied to the liquid in the liquid chamber to discharge the liquid from the nozzle hole; a driving waveform generation circuit configured to generate a driving waveform signal during a discharge control period having a predetermined cycle, to apply a driving waveform voltage to the piezoelectric element; a switch configured to selectively supply, to the piezoelectric element, at least one of a plurality of waveforms included in the driving waveform signal; and a controller configured to perform voltage setting control for applying a predetermined voltage to the piezoelectric element, in a case where a non-discharge control period, having a predetermined cycle, causes the piezoelectric element to change by a voltage that is greater than or equal to an allowable voltage, the non-discharge control period being a period during which the liquid is not discharged after the discharge control period.

DETAILED DESCRIPTION OF THE PREFERRED EMBODIMENTS

When the application of a voltage to the electrode of a piezoelectric element is stopped during a non-discharge control period, during which liquid is not discharged within the driving cycle, the voltage of the electrode of the piezoelectric element gradually decreases with respect to the reference voltage that is the starting voltage of the driving pulses, due to the leakage current. When the difference between the voltage of the electrode of the piezoelectric element and the reference voltage becomes greater than or equal to a predetermined value, at the time of generating the driving pulses in the next driving cycle, there is a possibility that the voltage of the electrode of the piezoelectric element rises sharply to the reference voltage, causing liquid to be erroneously discharged from the nozzle. Further, when the voltage changes sharply during the driving operation, an excessive current may be caused to flow to the control circuit, etc., that controls the recording head, and a failure may occur in the control circuit.

In order to prevent erroneous discharges or failures, it is considered to drive the gate circuit that controls the voltage applied to the piezoelectric element during the non-discharge control period, to maintain the voltage of the electrode of the piezoelectric element at the reference voltage during the non-discharge control period. However, when the heat generated by the driving of the gate circuit is transmitted to the recording head and the temperature of the recording head rises, the temperature of the liquid rises and the viscosity of the liquid decreases, making it difficult to control the discharging of the liquid. In particular, the shorter the driving cycle, the higher the number of times the gate circuit is driven per time unit, and thus the temperature of the recording head is likely to rise.

A problem to be addressed by an embodiment of the present invention is to prevent the heat generation of the recording head while inhibiting a decrease in the voltage of the electrode of the piezoelectric element, during a non-discharge control period.

Hereinafter, embodiments will be described with reference to the drawings.

Figure 1:
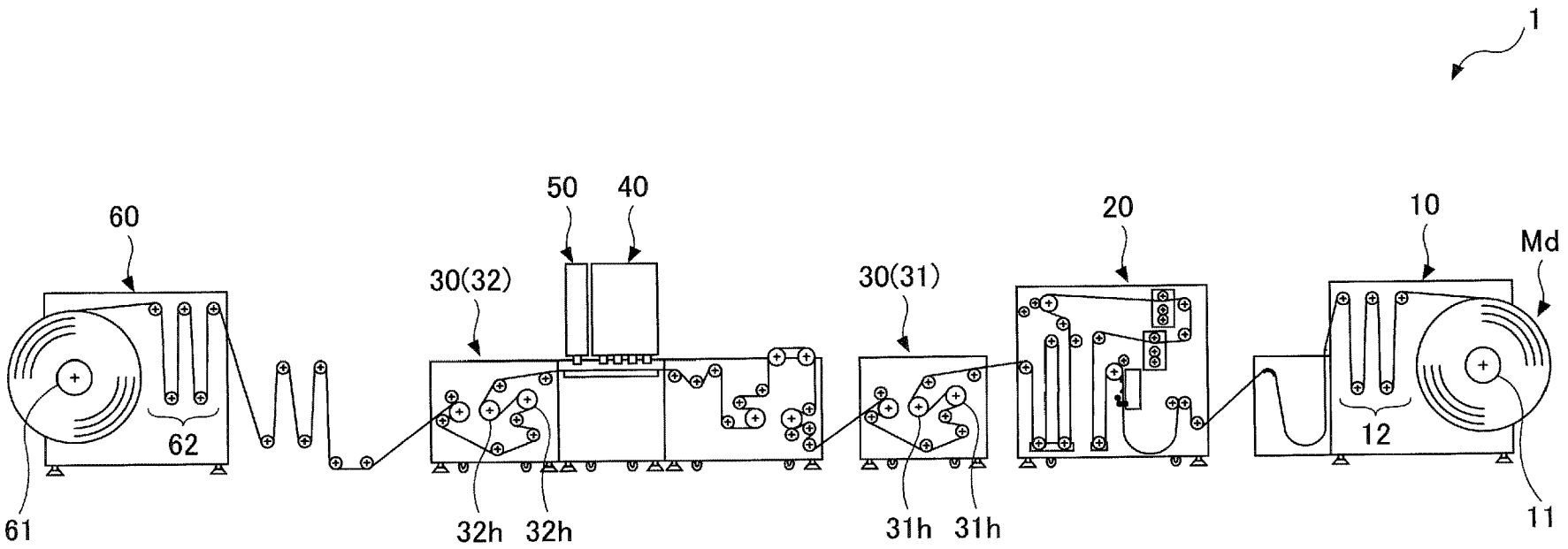
FIG. 1 is a diagram illustrating an example of an image forming system according to an embodiment of the present invention.

FIG. 1 is a diagram illustrating an example of an image forming system according to an embodiment. An image forming system 1 illustrated in FIG. 1 includes a carry-in unit 10 for carrying in roll paper Md, a pretreating unit 20 for performing pretreating on the carried in roll paper Md, and a drying unit 30 for drying the pretreated roll paper Md.

The image forming system 1 includes an image forming apparatus 40 including a liquid discharging apparatus for forming an image on the surface of a roll paper Md, a posttreating unit 50 for performing posttreating on the roll paper Md on which an image is formed, and a carry-out unit 60 for carrying out the post-processed roll paper Md. Further, the image forming system 1 includes a control unit (not illustrated) for controlling the operation of the image forming system 1.

The image forming system 1 carries in the roll paper Md by the carry-in unit 10 and performs pretreating and drying on the surface of the roll paper Md by the pretreating unit 20 and the drying unit 30. The image forming system 1 forms an image on the surface of the roll paper Md, which has been subjected to pretreating and drying, by the image forming apparatus 40. Further, the image forming system 1 performs posttreating on the roll paper Md, on which the image is formed, by the posttreating unit 50. Thereafter, the image forming system 1 winds up the roll paper Md and ejects or carries out the roll paper Md by the carry-out unit 60.

The image forming system 1 may be configured such that any one or more of the units such as the pretreating unit 20 or the like, are not included, except for the image forming apparatus 40, depending on the type of the medium on which images are formed.

The roll paper Md is not limited to roll paper. For example, the roll paper Md may be cut paper. Further, the roll paper Md may be a medium on which information can be recorded. For example, the roll paper Md may be plain paper, quality paper, thin paper, cardboard, recording paper, Overhead Projector (OHP) sheets, synthetic resin films, and metal films.

For example, the image forming system 1 includes a liquid discharging apparatus including dischargers corresponding to four colors that are black (K), cyan (C), magenta (M), and yellow (Y). However, the image forming system 1 may include a liquid discharging apparatus including dischargers corresponding to other colors such as green (G), red (R), and light cyan (LC), and may include a liquid discharging apparatus including a discharger corresponding to only black (K).

The image forming apparatus 40 including the liquid discharging apparatus is not limited to the form of being mounted in the image forming system 1 illustrated in FIG. 1. For example, the image forming apparatus 40 may be an apparatus for discharging liquid droplets of liquid such as ink, from a liquid discharging apparatus including a discharger such as a discharge head, an ink head, a recording head, and an ink jet, in a printer, a scanner, a copier, a plotter, and a facsimile machine.

Further, embodiments according to the present invention may be applied to a device for forming, printing, copying, or recording an image or characters on the surface of the roll paper Md.

The carry-in unit 10 is a means for conveying the roll paper Md to the pretreating unit 20 or the like. In the present embodiment, the carry-in unit 10 includes a sheet feeding unit 11 and a plurality of conveying rollers 12. The carry-in unit 10 carries and moves the roll paper Md held by being wound around a paper feed roll of the sheet feeding unit 11, by using the conveying rollers 12 or the like, and conveys the roll paper Md to the pretreating unit 20 (a platen) or the like.

The pretreating unit 20 is a means for treating the roll paper Md before the image is formed. In the present embodiment, the pretreating unit 20 performs pretreatment on the surface of the roll paper Md, carried in by the carry-in unit 10, with a pretreatment liquid. The pretreatment is a process in which a pretreatment liquid having the function of agglomerating the ink is uniformly applied to the surface of the roll paper Md. The pretreatment liquid is, for example, a treatment liquid containing water-soluble aliphatic organic acid.

The drying unit 30 is a means for drying the roll paper Md by heating or the like. The drying unit 30 includes a pretreating drying unit 31 for drying the roll paper Md pretreated by the pretreating unit 20 and a posttreating drying unit 32 for drying the roll paper Md posttreated by the posttreating unit 50.

The pretreating drying unit 31 includes, for example, a heat roller 31*h*. The pretreating drying unit 31 heats the heat roller 31*h*, for example, to 50° C. to 100° C., and brings the surface of the roll paper Md coated with the pretreatment liquid into contact with the heat roller 31*h*. The pretreating drying unit 31 can heat the surface of the roll paper Md coated with the pretreatment liquid by the heat roller 31*h*, evaporate the water content of the pretreatment liquid, and dry the roll paper Md. The posttreating drying unit 32 has the same configuration as the pretreating drying unit 31.

The image forming apparatus 40 includes a liquid discharging apparatus and is a means for forming an image on the roll paper Md. The image forming apparatus 40 controls the liquid discharging apparatus to discharge liquid droplets (hereinafter referred to as ink) onto the roll paper Md dried by the drying unit 30 to form an image on the surface of the roll paper Md. Details of the liquid discharging apparatus are described below.

The posttreating unit 50 is a means for treating the roll paper Md after the image is formed on the roll paper Md. The posttreating unit 50 performs posttreatment on the surface of the roll paper Md on which an image is formed by the image forming apparatus 40, with a posttreatment liquid. The posttreatment is a process in which the posttreatment liquid is discharged in spot shapes on the roll paper Md.

Figure 2:
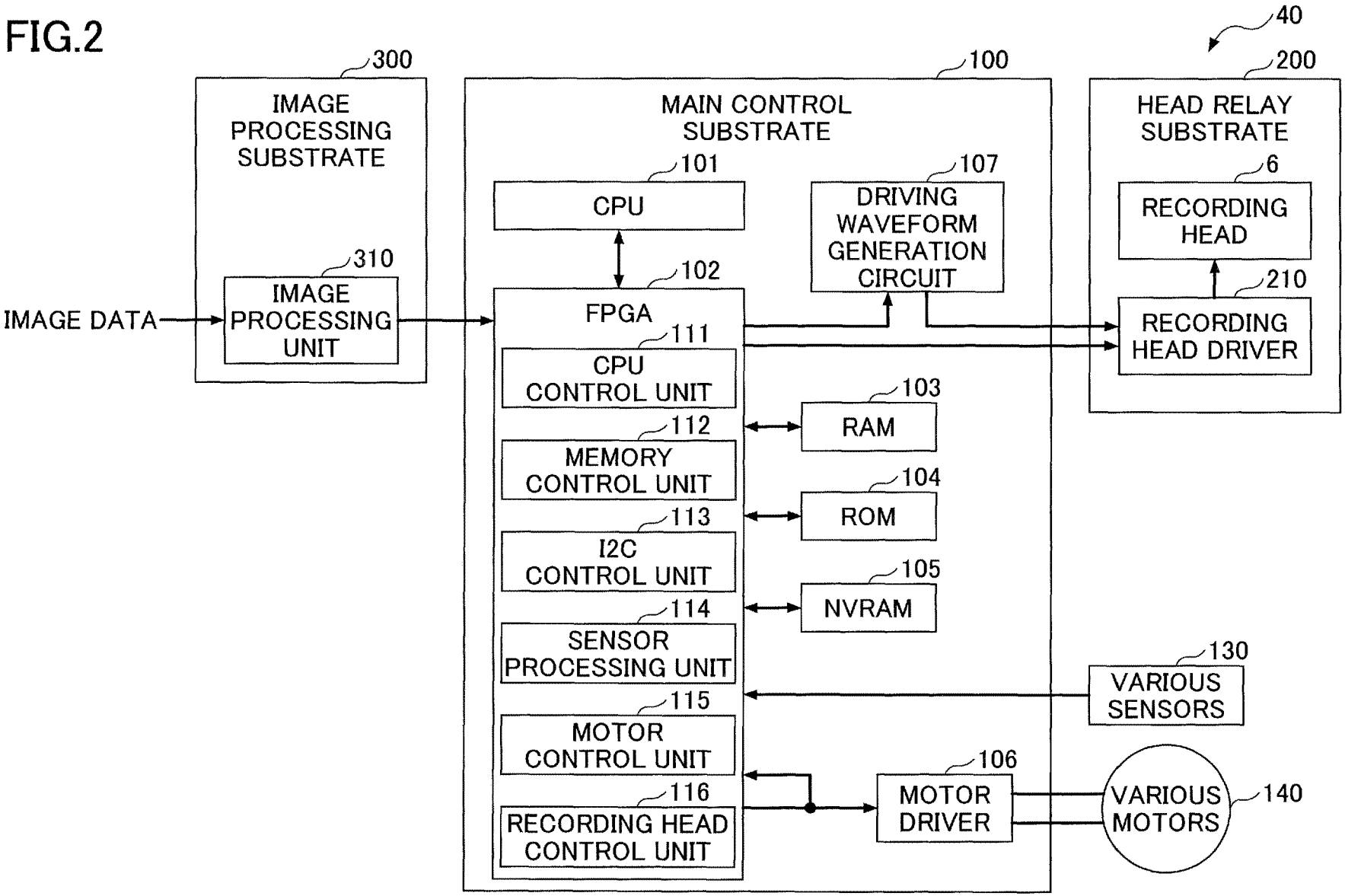
FIG. 2 is a block diagram illustrating an example of a hardware configuration of an image forming apparatus according to an embodiment of the present invention.

FIG. 2 is a block diagram illustrating an example of a hardware configuration of the image forming apparatus 40 according to an embodiment. The image forming apparatus 40 includes a main control substrate 100, a head relay substrate 200, and an image processing substrate 300.

The main control substrate 100 includes a Central Processing Unit (CPU) 101, a Field-Programmable Gate Array (FPGA) 102, a Random Access Memory (RAM) 103, a Read-Only Memory (ROM) 104, a Non-Volatile Random Access Memory (NVRAM) 105, a motor driver 106, and a driving waveform generation circuit 107 (driving waveform generator), etc.

The CPU 101 controls the entire image forming apparatus 40. For example, the CPU 101 uses the RAM 103 as a working area to execute various control programs stored in the ROM 104, and outputs control commands for controlling various operations in the image forming apparatus 40. In this case, the CPU 101 cooperates with the FPGA 102 to perform various kinds of operation control in the image forming apparatus 40, while communicating with the FPGA 102.

The FPGA 102 includes a CPU control unit 111, a memory control unit 112, an Inter-Integrated Circuit (I2C) control unit 113, a sensor processing unit 114, a motor control unit 115, and a recording head control unit 116 (voltage controller).

The CPU control unit 111 has a function for communicating with the CPU 101. The memory control unit 112 has a function for accessing the RAM 103 or the ROM 104. The I2C control unit 113 has a function for communicating with the NVRAM 105.

The sensor processing unit 114 processes the sensor signals of various sensors 130. The various sensors 130 are a collective term for referring to sensors that sense various states of the image forming apparatus 40. The various sensors 130 include an encoder sensor, a paper sensor for detecting the passage of a recording sheet, a cover sensor for detecting the opening of a cover member, a temperature and humidity sensor for detecting the ambient temperature and humidity, a paper fixing lever sensor for detecting the operation state of a lever for fixing the recording sheet, and a remaining amount detecting sensor for detecting the remaining ink amount in a cartridge. The analog sensor signal output from the temperature and humidity sensor is converted to a digital signal by an AD converter mounted, for example, on the main control substrate 100, and is input to the FPGA 102.

The motor control unit 115 controls various motors 140. The various motors 140 are a collective term for referring to motors provided in the image forming apparatus 40. The various motors 140 include a main scanning motor for operating a carriage, a sub-scanning motor for conveying a recording sheet in the sub-scanning direction, a paper feed motor for feeding a recording sheet, and a maintenance motor for operating a maintenance mechanism.

Here, an example of the operation control of the main scanning motor will be described, as a specific example of the control by cooperation between the CPU 101 and the motor control unit 115 of the FPGA 102. First, the CPU 101 reports, to the motor control unit 115, the movement speed and the travel distance of a carriage along with an instruction to start the operation of the main scanning motor. The motor control unit 115 that has received this instruction generates a driving profile based on the information of the movement speed and the travel distance reported from the CPU 101, and calculates a Pulse Width Modulation (PWM) command value and outputs the value to the motor driver 106 while making a comparison with an encoder value supplied from the sensor processing unit 114 (a value obtained by processing the sensor signal of the encoder sensor). When a predetermined operation is completed, the motor control unit 115 reports, to the CPU 101, the completion of the operation. Although an example in which the motor control unit 115 generates a driving profile is described above, the image forming apparatus 40 may have a configuration in which the CPU 101 generates a driving profile and gives an instruction to the motor control unit 115. The CPU 101 also counts the number of printed sheets and the number of scans of the main scanning motor.

The recording head control unit 116 transfers head driving data, a discharge synchronization signal LINE, and a discharge timing signal CHANGE stored in the ROM 104, to the driving waveform generation circuit 107, to cause the driving waveform generation circuit 107 to generate a common driving waveform signal Vcom. The common driving waveform signal Vcom generated by the driving waveform generation circuit 107 is input to a recording head driver 210, as described below, mounted on the head relay substrate 200.

Figure 3:
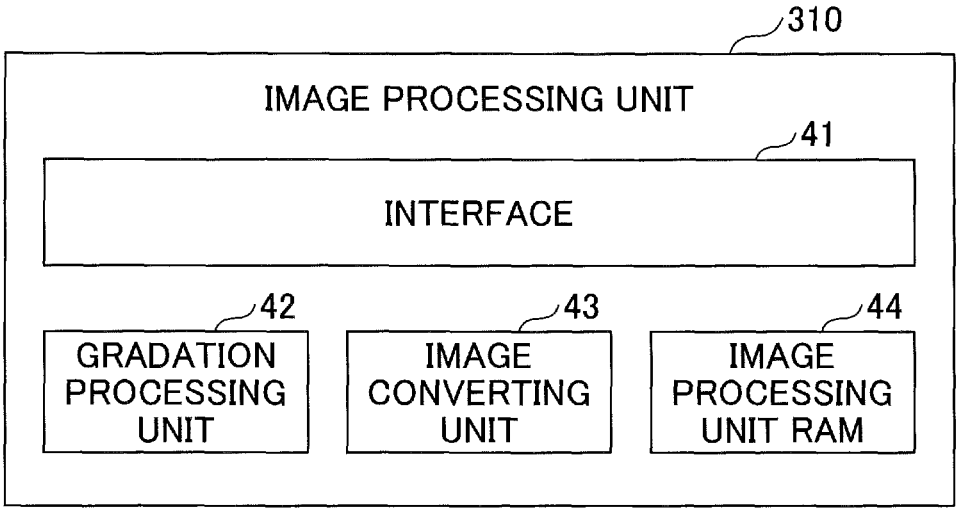
FIG. 3 is a functional block diagram illustrating an example of a configuration of an image processing unit according to an embodiment of the present invention.

FIG. 3 is a functional block diagram illustrating a configuration example of an image processing unit 310 mounted on the image processing substrate 300 illustrated in FIG. 2.

The image processing unit 310 performs gradation processing, image conversion processing, or the like on received image data, and converts the image data into a format that can be processed by the recording head control unit 116. The image processing unit 310 outputs the converted image data to the recording head control unit 116.

Specifically, the image processing unit 310 includes an interface 41, a gradation processing unit 42, an image converting unit 43, and an image processing unit RAM 44.

The interface 41 is an input unit for inputting image data and is a communication interface with respect to the CPU 101 and the FPGA 102. The gradation processing unit 42 performs gradation processing on received multi-value image data and converts the image data to small value image data. The small value image data is image data having a gradation number corresponding to the type of liquid droplets (a large droplet, a medium droplet, or a small droplet) discharged by a recording head 6 mounted on the head relay substrate 200 as illustrated in FIG. 2. The gradation processing unit 42 holds the converted image data with correspondence to one band or more in the image processing unit RAM 44. The image data with correspondence to one band is image data corresponding to the width of the maximum sub-scanning direction in which recording can be performed by one scanning operation by the recording head 6 in a main scanning direction X.

The image converting unit 43 converts the image data corresponding to one band in the image processing unit RAM 44, in units of images output by one scanning operation (one scan) in the main scanning direction X. This conversion is performed in line with the configuration of the recording head 6, according to the information of the printing order and the printing width (sub-scanning width of image recording per scan) accepted from the CPU 101 through the interface 41.

The printing order and the printing width may correspond to one-pass printing, in which an image is formed by one main scanning operation with respect to the recording medium, or may correspond to multi-pass printing, in which an image is formed by two or more main scanning operations by the same nozzle group or different nozzle groups with respect to the same area of the recording medium. Further, the heads may be arranged in the main scanning direction, and ink may be ejected to the same area by different nozzles. These recording methods may be appropriately combined.

The printing width is the width in the sub-scanning direction Y of an image recorded by one scanning operation (one scan) by the recording head 6 (see FIGS. 2 and 5) in the main scanning direction X. In the present embodiment, the printing width is set by the CPU 101.

The image converting unit 43 outputs the converted image data SD' to the FPGA 102 via the interface 41.

The functions of the image processing unit 310 may be executed as hardware functions such as FPGA or Application Specific Integrated Circuit (ASIC), or may be implemented by image processing programs stored in a storage device inside the image processing unit 310.

The functions of the image processing unit 310 may be executed by software installed in a computer, and not within the image forming apparatus 40.

Figure 4:
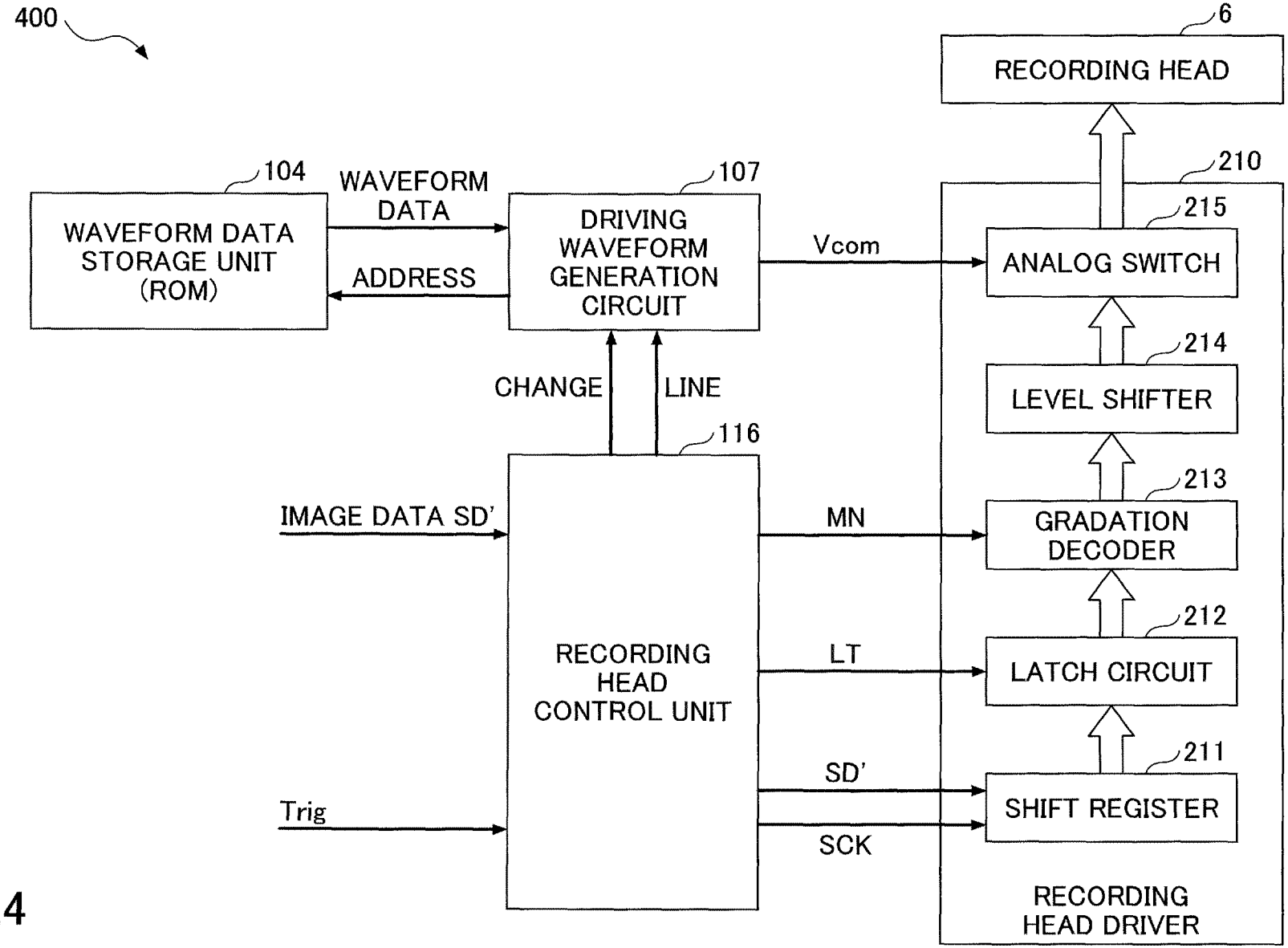
FIG. 4 is a block diagram illustrating an example of a configuration of a recording head control unit, a driving waveform generation circuit, and a recording head driver according to an embodiment of the present invention.

FIG. 4 is a block diagram illustrating an example of a configuration of the recording head control unit 116, the driving waveform generation circuit 107, and the recording head driver 210. For example, FIG. 4 illustrates an example of a liquid discharging apparatus 400, included in the image forming apparatus 40 illustrated in FIGS. 1 and 2, according to an embodiment of the present invention.

The recording head control unit 116 receives a trigger signal Trig that triggers the discharge timing, and then outputs a discharge synchronization signal LINE that triggers the generation of a driving waveform, to the driving waveform generation circuit 107. Further, the recording head control unit 116 outputs a discharge timing signal CHANGE, corresponding to the delay amount from the discharge synchronization signal LINE, to the driving waveform generation circuit 107 (see FIG. 4). The driving waveform generation circuit 107 outputs an address to the ROM 104 and accesses the ROM 104, and reads the waveform data stored in a waveform data storage unit allocated in the ROM 104. The driving waveform generation circuit 107 generates a common driving waveform signal Vcom corresponding to the waveform data read from the waveform data storage unit, at a timing based on the discharge synchronization signal LINE and the discharge timing signal CHANGE.

Further, the recording head control unit 116 receives the image data SD' that has undergone the image processing from the image processing unit 310 provided in the image processing substrate 300, and based on the image data SD', the recording head control unit 116 generates a mask control signal MN for selecting a predetermined waveform of the common driving waveform signal Vcom according to the size of the ink droplets to be discharged from each nozzle hole 62 (a hole of each nozzle) (see FIG. 5) of the recording head 6. The mask control signal MN is a timing signal synchronized with the discharge timing signal CHANGE. Then, the recording head control unit 116 transfers, to the recording head driver 210, the image data SD', a synchronization clock signal SCK, a latch signal LT instructing the latching of the image data, and the generated mask control signal MN.

The recording head driver 210 includes a shift register 211, a latch circuit 212, a gradation decoder 213, a level shifter 214, and an analog switch 215 as illustrated in FIG. 4.

The shift register 211 inputs the image data SD' and the synchronization clock signal SCK transferred from the recording head control unit 116. The latch circuit 212 latches each register value of the shift register 211 by a latch signal LT transferred from the recording head control unit 116.

The gradation decoder 213 decodes the value latched by the latch circuit 212 (the image data SD') and the mask control signal MN and outputs the result of the decoding. The level shifter 214 converts the logic level voltage signal of the gradation decoder 213 to a level at which the analog switch 215 is operable.

The analog switch 215 is a switch that is turned on/off by the output of the gradation decoder 213 provided via the level shifter 214. The analog switch 215 is provided for each nozzle hole 62 provided in the recording head 6, and is connected to an individual electrode 83 of a piezoelectric element 70 corresponding to each nozzle hole 62 (see FIG. 5). The analog switch 215 also receives input of a common driving waveform signal Vcom from the driving waveform generation circuit 107. Also, as described above, the timing of the mask control signal MN is synchronized with the timing of the common driving waveform signal Vcom. Accordingly, the analog switch 215 is switched on/off at the appropriate timing in response to the output of the gradation decoder 213 provided through the level shifter 214, and, therefore, the waveform applied to the piezoelectric element 70 corresponding to each nozzle hole 62 is selected from among the driving waveforms constituting the common driving waveform signal Vcom. As a result, the size of the ink droplets discharged from the nozzle hole 62 is controlled.

The discharge timing signal CHANGE illustrated in FIG. 4 is used to adjust the phase of the common driving waveform signal Vcom generated in synchronization with the discharge synchronization signal LINE. For example, the discharge timing signal CHANGE represents any of the digital values from 1 to 13, and the smaller the digital value, the earlier the phase of the common driving waveform signal Vcom. When the value of the discharge timing signal CHANGE is 7, the phase of the common driving waveform signal Vcom becomes the reference phase.

Figure 5:
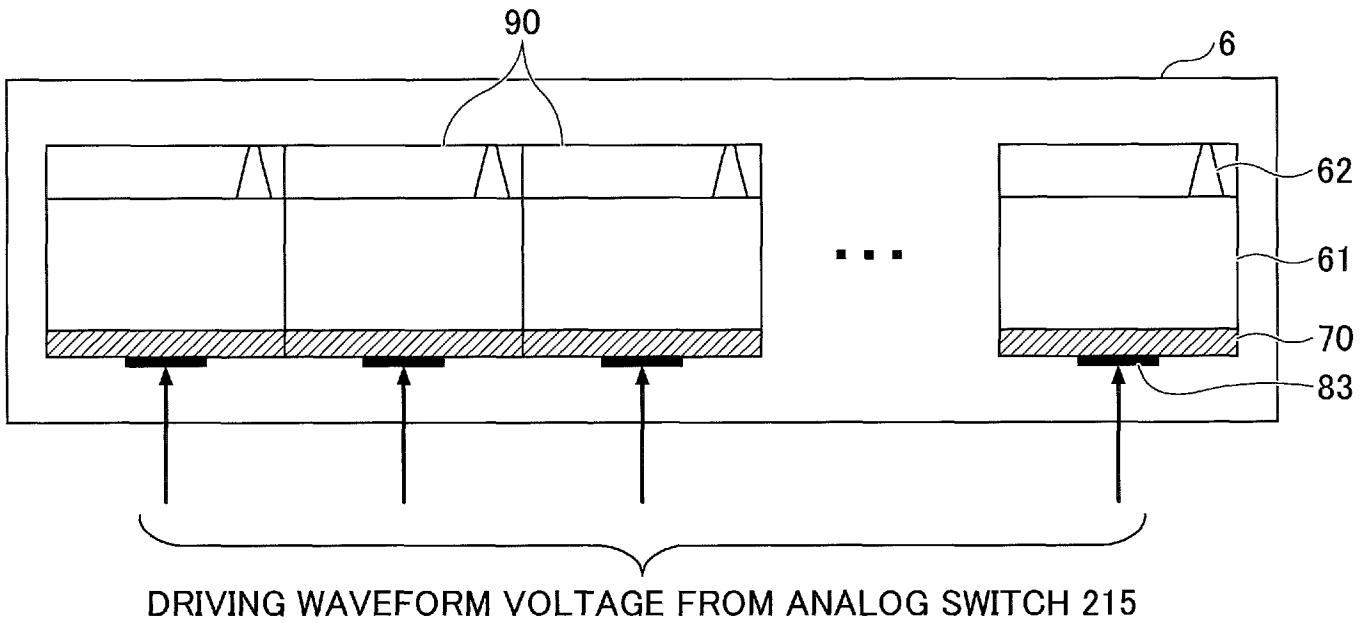
FIG. 5 is a schematic diagram illustrating an example of a configuration of a recording head according to an embodiment of the present invention.

FIG. 5 is a schematic diagram illustrating a configuration example of the recording head 6. The recording head 6 includes a plurality of discharge blocks 90, each including a pressurizing liquid chamber 61, the piezoelectric element 70, and the nozzle hole 62.

For example, each piezoelectric element 70 is in contact with a wall surface adjacent to the pressurizing liquid chamber 61, that is, a wall surface facing a wall surface in which the nozzle hole 62 is provided, and the piezoelectric element 70 deforms as a result of receiving a driving waveform voltage from the analog switch 215 of FIG. 4 at the individual electrode (input terminal) 83. According to the deformation of the piezoelectric element 70, the pressurizing liquid chamber 61 that is in communication with the nozzle hole 62 deforms, and the pressure of the ink in the pressurizing liquid chamber 61 changes. When the ink in the pressurizing liquid chamber 61 is pressurized, the pressurized ink is discharged as liquid droplets from the nozzle hole 62.

Figure 6:
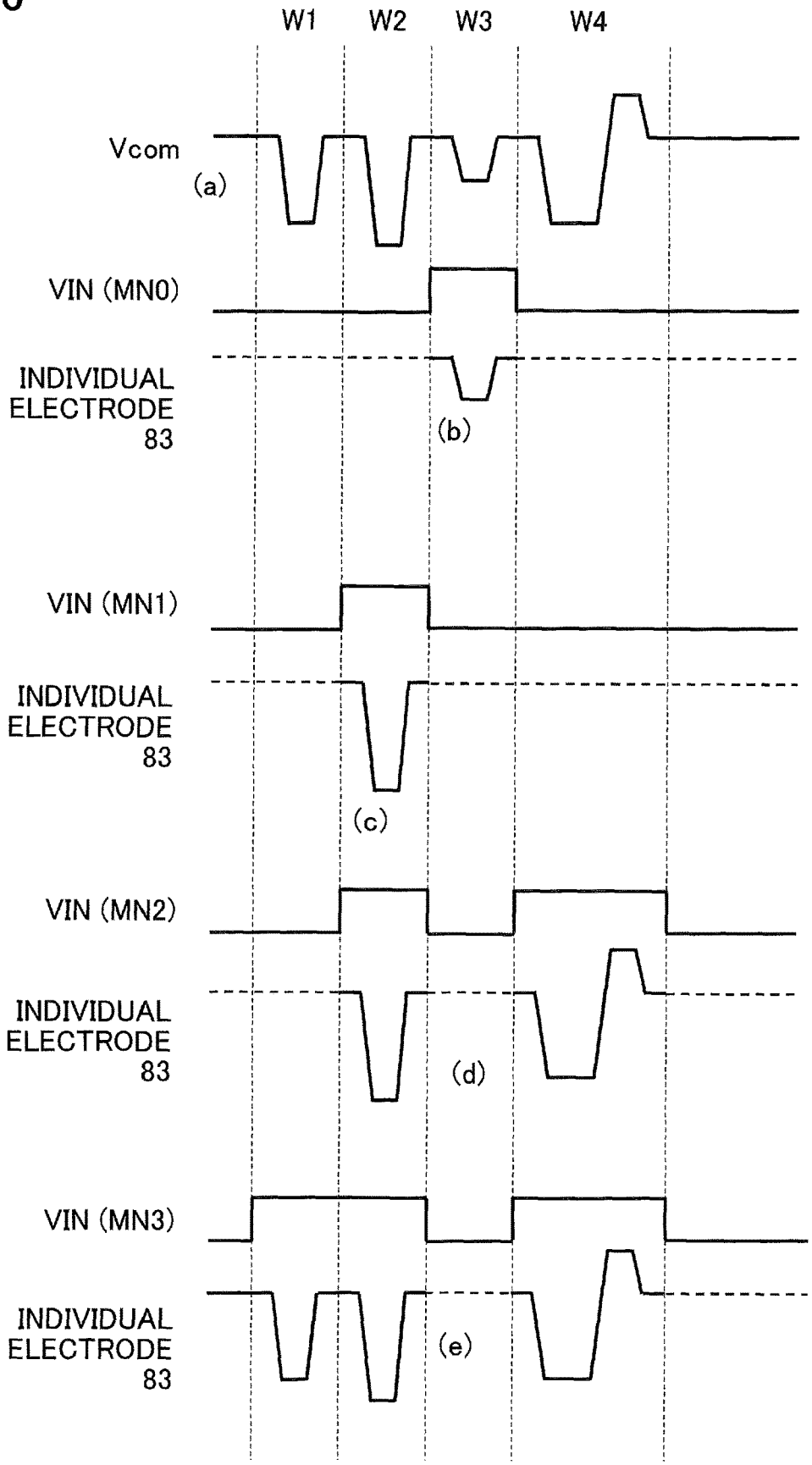
FIG. 6 is a diagram illustrating examples of the types of mask control signals and voltage waveforms applied to individual electrodes according to an embodiment of the present invention.

FIG. 6 is a diagram illustrating examples of types of mask control signals MN and voltage waveforms applied to the individual electrode 83. The driving waveform generation circuit 107 of FIG. 4 outputs a common driving waveform signal Vcom corresponding to a phase according to the discharge timing signal CHANGE, in synchronization with the discharge synchronization signal LINE. The common driving waveform signal Vcom includes, but is not limited to, four waveforms W1, W2, W3, and W4 ((a) in FIG. 6).

First, the operation until the mask control signal MN is output to the analog switch 215 of FIG. 4 will be described. The recording head control unit 116 of FIG. 4 outputs the four mask control signals MN (MN0, MN1, MN2, and MN3) in parallel, in synchronization with the discharge synchronization signal LINE. The mask control signal MN0 has a rectangular pulse including the generation period of the waveform W3 of the common driving waveform signal Vcom. The mask control signal MN1 has a rectangular pulse including the generation period of the waveform W2 of the common driving waveform signal Vcom. The mask control signal MN2 has two rectangular pulses, respectively including the generation periods of the waveforms W2 and W4 of the common driving waveform signal Vcom. The mask control signal MN3 has two rectangular pulses, respectively including the generation periods of the waveforms W1 and W2 and the generation period of the waveform W4 of the common driving waveform signal Vcom.

For example, the recording head control unit 116 receives the image data SD' having a number of pixels corresponding to the number of the nozzle holes 62 of the recording head 6, and outputs the received image data SD' as serial data to the shift register 211 in synchronization with the synchronization clock signals SCK. The shift register 211 sequentially receives pieces of the serial image data SD' in synchronization with the synchronization clock signals SCK, and shifts the pieces of the serial image data SD' in the shift register 211 while sequentially receiving the pieces of the serial image data SD', and holds the serial image data SD' in the shift register 211. Then, the shift register 211 outputs the held image data SD' to the latch circuit 212 as parallel data.

The latch circuit 212 latches the parallel image data SD' in synchronization with the latch signal LT output from the recording head control unit 116, for each piece of the image data SD' having a number of pixels corresponding to the number of nozzle holes 62, and outputs the latched image data SD' to the gradation decoder 213.

The gradation decoder 213 decodes the gradation of the pixel data corresponding to each nozzle hole 62 of the recording head 6 included in the image data SD'. The gradation decoder 213 outputs the mask control signal MN (any of MN0 to MN3) corresponding to the decoded gradation, to the level shifter 214 for each pixel data. That is, the number of mask control signals MN output to the level shifter 214 is equal to the number of nozzle holes 62. The level shifter 214 converts the voltage level of the received mask control signal MN and outputs the mask control signal MN to the analog switch 215.

The analog switch 215 has a gate circuit for the piezoelectric element 70 corresponding to each of the plurality of nozzle holes 62 in the recording head 6. Each gate circuit applies a waveform of the common driving waveform signal Vcom to the individual electrode 83 of the piezoelectric element 70 according to the corresponding mask control signal MN. For example, each gate circuit is turned on in synchronization with a rectangular pulse of the mask control signal MN received at the gate input terminal VIN and selectively outputs a portion of the waveform of the common driving waveform signal Vcom as a driving waveform voltage to the individual electrode 83. Thus, the mask control signals MN0 to MN3 are a plurality of selection patterns for selecting at least one of a plurality of waveforms W1, W2, W3, and W4 included in the common driving waveform signal Vcom.

Accordingly, any one of the four voltage waveforms is applied to the individual electrode 83 in accordance with the gradation of the image data SD' for each pixel. Each gate circuit of the analog switch 215 functions as a switch that selectively supplies at least one of a plurality of waveforms included in the common driving waveform signal Vcom, to the individual electrode 83 of the piezoelectric element 70.

The waveform W3 applied to the individual electrode 83 based on the mask control signal MN0 is used to vibrate the meniscus surface of the nozzle hole 62 without discharging ink from the nozzle hole 62 to prevent drying ((b) in FIG. 6). The waveform W2 applied to the individual electrode 83 based on the mask control signal MN1 is used to discharge a first amount (small droplet) of ink from the nozzle hole 62 ((c) of FIG. 6).

The waveforms W2 and W4 applied to the individual electrode 83 based on the mask control signal MN2, are used to discharge a second amount (medium droplet) of ink from nozzle hole 62 ((d) of FIG. 6). The waveforms W1, W2, and W4 applied to the individual electrode 83 based on the mask control signal MN3 are used to discharge a third amount (large droplet) of ink from the nozzle hole 62 ((e) of FIG. 6).

The dashed line in the waveform of the individual electrode 83 indicates the period during which the gate circuit does not apply a waveform to the individual electrode 83, and the individual electrode 83 is set to the reference voltage of the floating state during the period indicated by the dashed line. During the floating state, the voltage of the individual electrode 83 gradually decreases due to a leakage current flowing through a leakage path. The voltage drop of the individual electrode 83 due to the leakage current will be described in FIG. 11.

Figure 7:
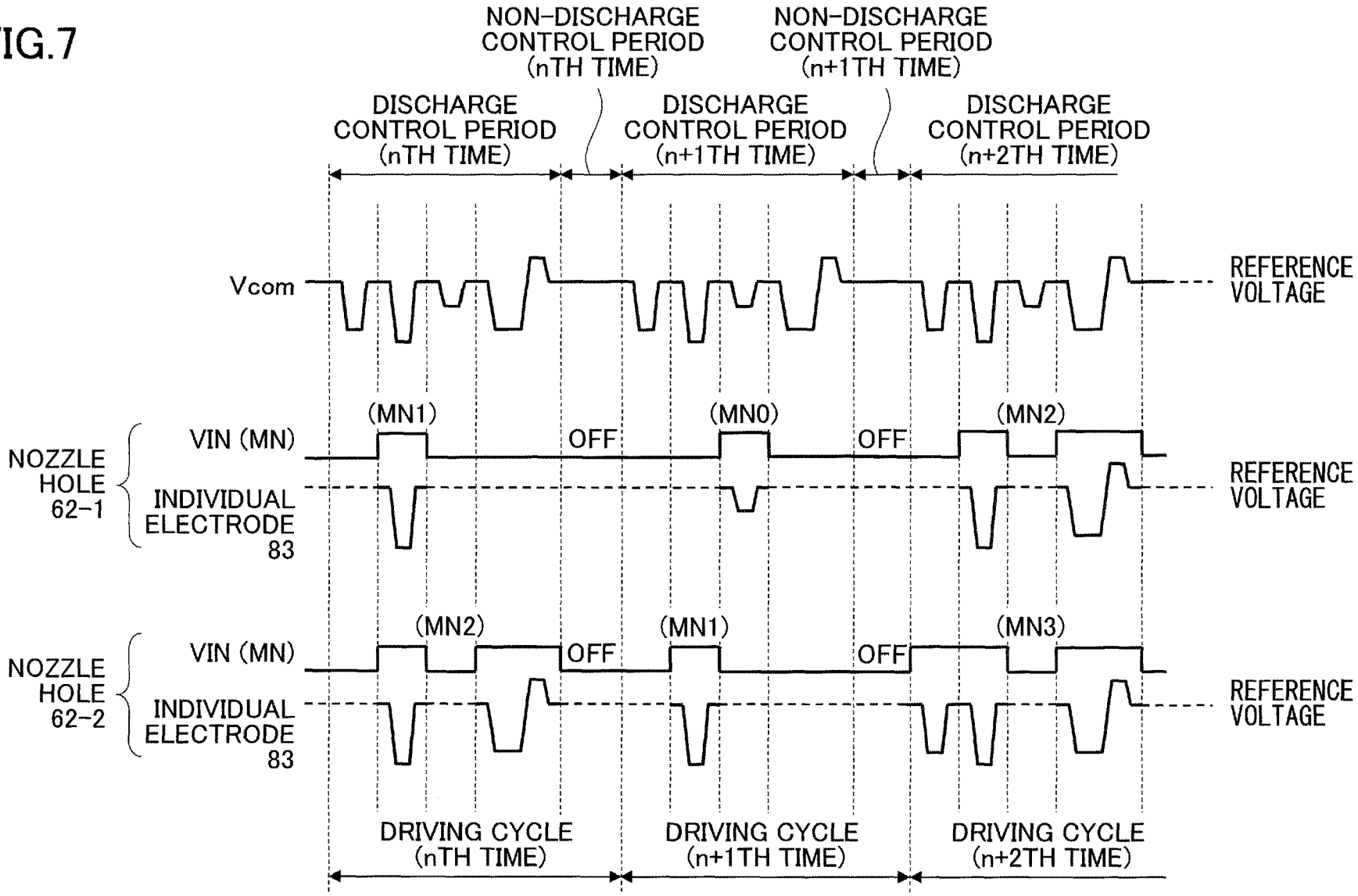
FIG. 7 is a waveform diagram illustrating an example of an operation of a liquid discharging apparatus according to an embodiment of the present invention.
Figure 8:
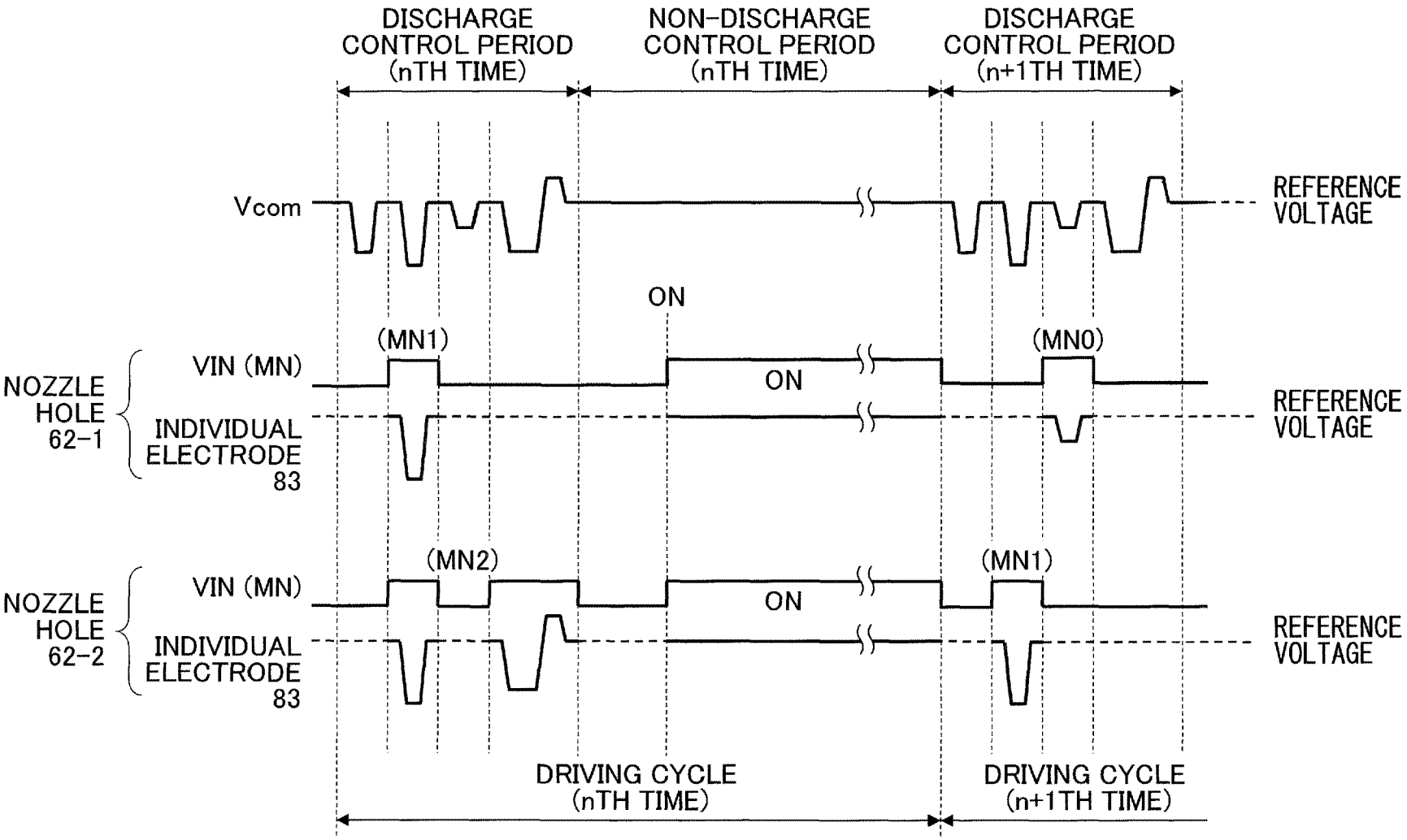
FIG. 8 is a waveform diagram illustrating another example of an operation of a liquid discharging apparatus according to an embodiment of the present invention.

FIGS. 7 and 8 are waveform diagrams illustrating an example of the operation of the liquid discharging apparatus 400 according to an embodiment. FIG. 7 illustrates waveforms when the driving cycle is shorter than a predetermined first cycle, and FIG. 8 illustrates waveforms when the driving cycle is longer than the first cycle. The first cycle will be described in FIG. 9. For example, the driving cycle is shorter in an operation mode in which the speed of feeding paper for printing images is fast, and the driving cycle is longer in an operation mode in which the speed of feeding paper for printing images is slow. Alternatively, the driving cycle may be shorter in an operation mode in which the resolution of printing is low, and longer in an operation mode in which the resolution of printing is high.

In FIGS. 7 and 8, one driving cycle includes a discharge control period in which control for discharging ink is executed, and a non-discharge control period in which control for discharging ink is not executed. For example, the discharge control period is constant regardless of the driving cycle, and the waveform of the common driving waveform signal Vcom is common for each discharge control period. On the other hand, the non-discharge control period becomes longer as the driving cycle becomes longer, and the common driving waveform signal Vcom is maintained at a reference voltage (intermediate voltage).

Although FIGS. 7 and 8 illustrate operation waveforms for discharging ink from two nozzle holes 62-1 and 62-2, the operation illustrated in FIG. 7 or 8 is performed with respect to all of the nozzle holes 62 included in the recording head 6. In the discharge control period, as described in FIG. 6, a waveform corresponding to the mask control signal MN received at the gate input terminal VIN of the gate circuit is applied to the individual electrode 83.

As illustrated in FIG. 7, if the driving cycle is shorter than the first cycle, each mask control signal MN provided to the gate input terminal VIN is set to a low level during the non-discharge control period. The gate circuit is off when a low level voltage is received, and does not apply the common driving waveform signal Vcom to the individual electrode 83. That is, the recording head control unit 116 and the recording head driver 210 do not perform voltage setting control in which a reference voltage is applied to the individual electrodes 83 of the piezoelectric element 70, during the non-discharge control period. Thus, as indicated by a dashed line in the voltage waveform of the individual electrode 83, the individual electrode 83 is set to a floating state during the non-discharge control period.

By setting the mask control signal MN to a low level in the non-discharge control period, the number of times the gate circuit is driven per time unit can be prevented from increasing, and the temperature of the gate circuit can be prevented from rising excessively. Accordingly, the temperature of the recording head 6 can be prevented from rising, and the temperature of the ink in the pressurizing liquid chamber 61 can be prevented from exceeding the upper limit temperature, and the ink discharge control can be performed properly.

On the other hand, as illustrated in FIG. 8, when the driving cycle is longer than the first cycle, each mask control signal MN provided to the gate input terminal VIN changes from a low level to a high level during the non-discharge control period. The gate circuit is turned on when a high level mask control signal MN is received, and the gate circuit applies a common driving waveform signal Vcom (reference voltage) to the individual electrode 83 of the piezoelectric element 70. Thus, the individual electrode 83 is set to a reference voltage that is a predetermined constant voltage, as indicated by a solid line in the voltage waveform of the individual electrode 83. That is, in order to cause the gate circuit to perform a driving operation, the recording head control unit 116 and the recording head driver 210 perform voltage setting control in which a reference voltage is applied to the individual electrode 83 of the piezoelectric element 70 during the non-discharge control period.

For example, each mask control signal MN changes to a high level after a predetermined time from the start of the non-discharge control period (i.e., the end of the discharge control period). The on-timing of the gate circuit during the non-discharge control period does not depend on the driving cycle but is determined based on the waveform data for generating the waveform of the mask control signal MN. For example, the non-discharge control period of FIG. 7 is shorter than the time from the start of the non-discharge control period to the on-timing of FIG. 8, and, therefore, the mask control signal MN does not change to a high level during the non-discharge control period, and the voltage setting control is not performed during the non-discharge control period in FIG. 7. The performing/not performing of voltage setting control will be described in FIG. 9.

The operations illustrated in FIGS. 7 and 8 are implemented by the recording head control unit 116, the shift register 211, the latch circuit 212, the gradation decoder 213, and the level shifter 214 illustrated in FIG. 4. That is, the recording head control unit 116, the shift register 211, the latch circuit 212, the gradation decoder 213, and the level shifter 214 function as control units for performing voltage setting control for applying a predetermined voltage to the piezoelectric elements 70 during the non-discharge control period.

By applying a reference voltage to the individual electrode 83 during the non-discharge control period, it is possible to prevent the voltage of the individual electrode 83 from decreasing due to a leakage current. Thus, for example, even when a rectangular pulse of the mask control signal MN is applied to the gate circuit during the discharge control period of the driving cycle of the n+1 time (n being an integer of one or more), it is possible to prevent the voltage of the individual electrode 83 from sharply rising to the reference voltage. As a result, it is possible to prevent an abnormal voltage (abnormal pulse) from being applied to the individual electrode 83, and it is possible to prevent ink from being erroneously discharged from the nozzle holes 62 due to an abnormal pulse. That is, it is possible to prevent a malfunction of the liquid discharging apparatus 400, and it is possible to prevent a decrease in the quality of printing on paper or the like by the image forming apparatus 40.

For example, the recording head control unit 116 illustrated in FIG. 4 holds waveform data for generating a waveform of a length corresponding to the longest driving cycle, for each mask control signal MN. The on-timing ON of each mask control signal MN in the non-discharge control period illustrated in FIG. 8 is set, for example, to occur a first time period or longer before the end of the first cycle (i.e., the start of the next discharge control period). Thus, just by preparing one waveform for each mask control signal MN, the switching between performing/not performing of the voltage setting control illustrated in FIGS. 7 and 8, can be done automatically according to the driving cycle.

Figure 9:
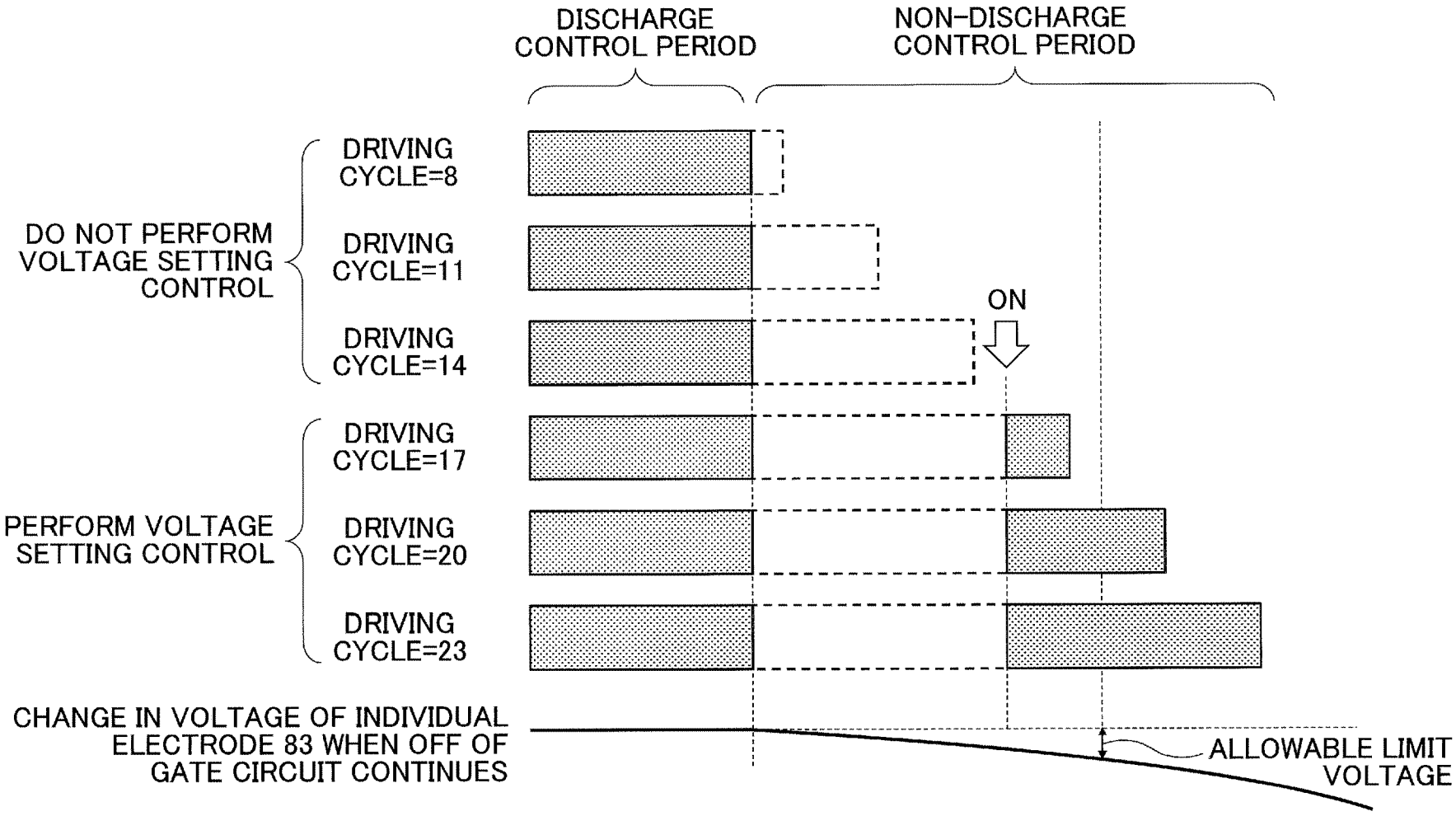
FIG. 9 is an explanatory diagram illustrating an example of switching between performing/not performing of the voltage setting control according to an embodiment of the present invention.

FIG. 9 is a diagram illustrating an example of switching between performing/not performing of the voltage setting control. In FIG. 9, for example, six types of driving cycles are preset. Every third number from "8" to "23" indicated for each driving cycle indicates the time unit, with one time unit being a few microseconds, although not particularly limited thereto. For example, the discharge control period is 7 time units. The voltage setting control is performed for the driving cycle at 17 time units, 20 time units, and 23 time units; and the voltage setting control is not performed for the driving cycle at 8 time units, 11 time units, and 14 time units. That is, in the example illustrated in FIG. 9, the first cycle for determining whether the voltage setting control is to be performed, is 15 time units.

In order to make the explanation easier to understand, the timing at which the voltage of the individual electrode 83 falls below the allowable limit voltage (allowable voltage) when the gate circuit of the analog switch 215 continues to be turned off is, for example, 18 time units after the beginning of the discharge control period. However, the timing at which the voltage of the individual electrode 83 falls below the allowable limit voltage is not limited to after 18 time units. Here, the allowable limit voltage is a voltage at which there is a possibility that at the beginning of a subsequent discharge control period, the voltage of the individual electrode 83 rises sharply to the reference voltage, thereby generating an abnormal pulse that may cause ink to be erroneously discharged from the nozzle hole 62.

In the example illustrated in FIG. 9, for example, the on-timing ON for turning on the gate circuit during the non-discharge control period is set to 15 time units after the beginning of the discharge control period. In other words, the recording head control unit 116 holds waveform data by which the mask control signal MN changes to a high level at 15 time units after the beginning of the discharge control period, in all of the mask control signals MN.

The waveform data for generating the mask control signal MN is common to all driving cycles and is used in all driving cycles. That is, each of the mask control signals MN0 to MN3 (selection patterns) has a pattern length corresponding to the longest driving cycle with inclusion of an on-timing ON in the pattern corresponding to the non-discharge control period.

Thus, when the driving cycle is set to 20 time units or 23 time units, the voltage of the individual electrode 83 can be returned to the reference voltage before reaching the allowable limit voltage, thereby preventing erroneous discharging of ink from the nozzle hole 62 due to an abnormal pulse.

Note that the on-timing ON is set so as to occur a first time period or longer before the start of the discharge control period, in all driving cycles for which the on-timing ON can be set. That is, the recording head control unit 116 sets the timing of applying a reference voltage to the individual electrode 83 of the piezoelectric element 70 when the voltage setting control is performed, to occur a first time period or longer before the start timing of the discharge control period of any of the plurality of driving cycles. In other words, the end timing of the first cycle is set so as to be before the timing when the voltage of the individual electrode 83 would drop below the allowable limit voltage, and to occur a first time period or longer before the start of the discharge control period of a driving cycle that is longer than the first cycle.

For example, the first time period is set to a minimum time interval of transition edges adjacent to each other in two consecutive pulse waveforms generated during the discharge control period. That is, the first time period is the minimum time interval of two consecutive pulse waveforms generated during the discharge control period. In the example illustrated in FIG. 9, the on-timing ON is set so that when the driving cycle is 17 time units, the on-timing ON is set at 1 microsecond or more from the start of the discharge control period.

The time interval of the two consecutive pulse waveforms generated during the discharge control period is the time margin for allowing ink to be stably discharged from the nozzle hole 62. Accordingly, by allowing the time interval between the on-timing ON and the discharge control period to be longer than or equal to the first time period, it is possible to prevent the ink discharging by the first pulse of the discharge control period from becoming unstable, and it is possible to prevent the quality of printing onto paper or the like by the image forming apparatus 40 from decreasing. Note that if the discharging of ink by a first pulse becomes unstable, the unstable discharging may affect the ink discharging by subsequent pulses, and, therefore, it is important to stabilize the ink discharging by the first pulse.

At the on-timing ON illustrated in FIG. 9, when the driving cycle is set at 20 time units or 23 time units, which are longer than 17 time units, the on-timing ON will always be 1 microsecond or more from the start of the discharge control period. Further, when the driving cycle is set at 14 time units, 11 time units, or 8 time units, which is shorter than 17 time units, the gate circuit is not turned on during the non-discharge control period because the next discharge control period appears before the on-timing ON would occur. Therefore, when the driving cycle is shorter than 17 time units, the time interval between the on-timing ON and the discharge control period does not have to be considered.

Figure 10:
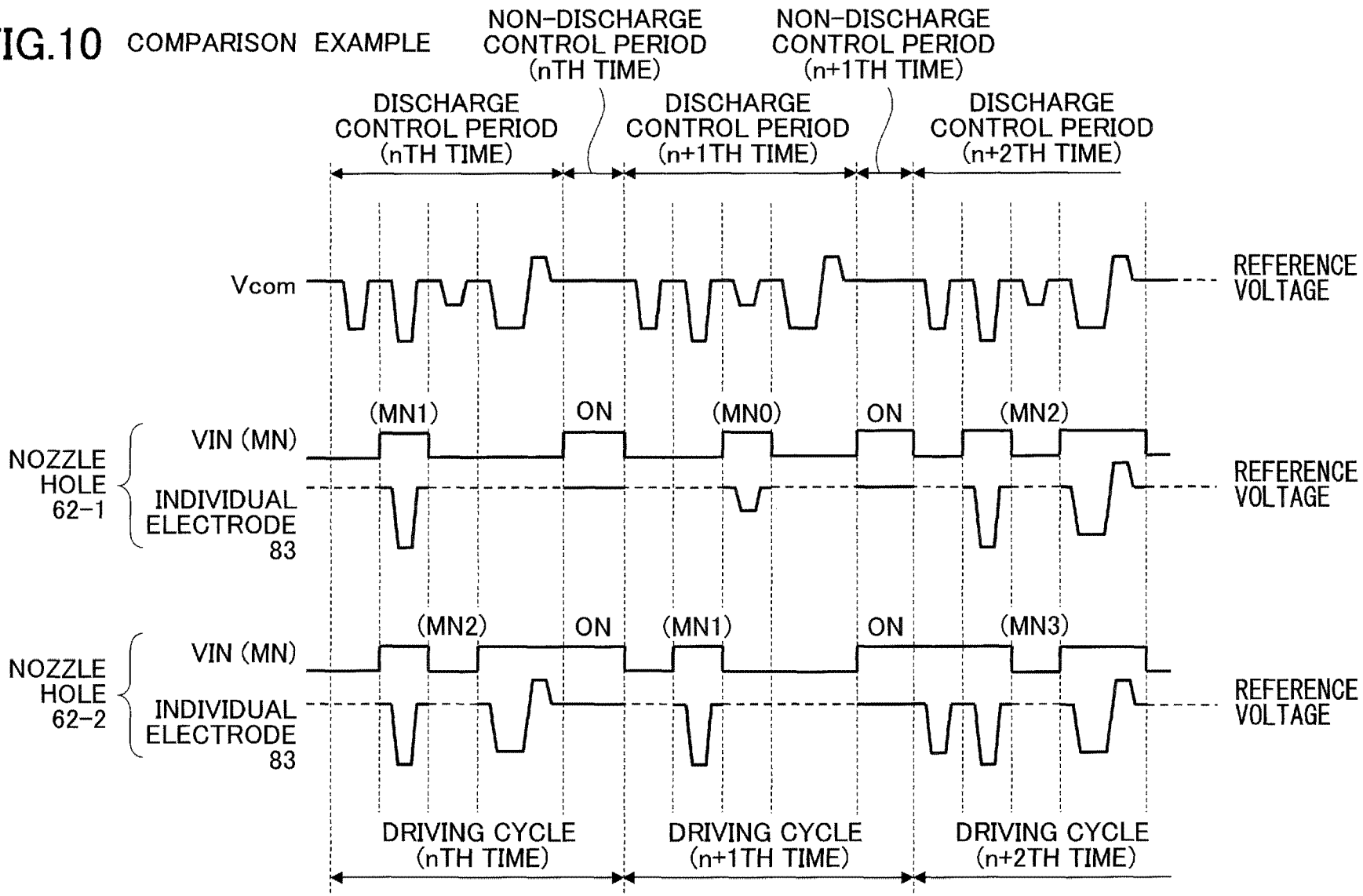
FIG. 10 is a waveform diagram illustrating an example of an operation of another liquid discharging apparatus (comparison example)
Figure 11:
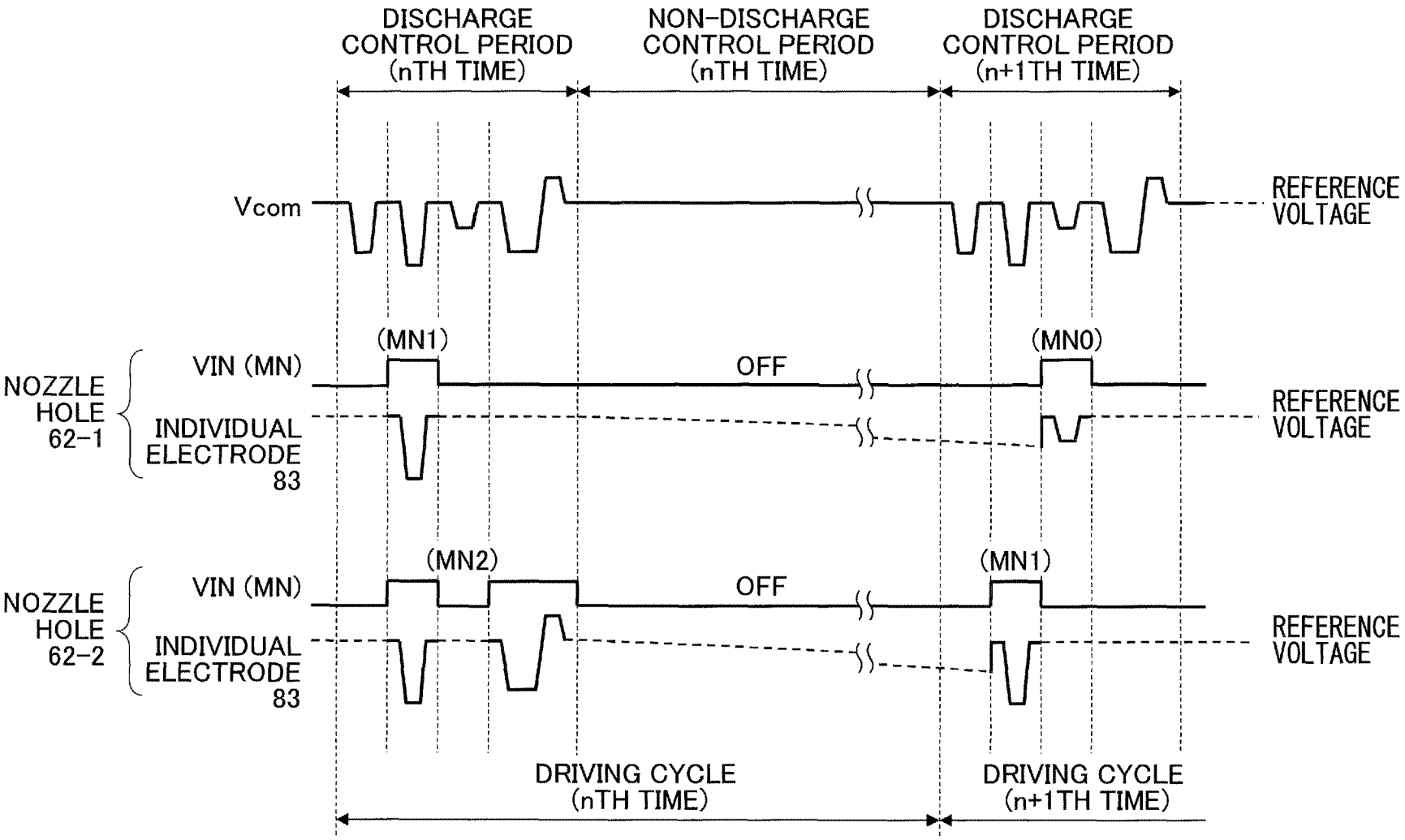
FIG. 11 is a waveform diagram illustrating another example of an operation of another liquid discharging apparatus (comparison example)

FIGS. 10 and 11 are waveform diagrams illustrating an example of an operation of another liquid discharging apparatus (comparison examples). FIG. 10 illustrates waveforms when the driving cycle is shorter than the first cycle, and FIG. 11 illustrates waveforms when the driving cycle is longer than the first cycle.

In FIG. 10, all mask control signals MN (MN0 to MN3) include pulses that turn on the gate circuit of the analog switch 215 during the non-discharge control period. That is, the recording head control unit 116 holds waveform data for generating the mask control signals MN0 to MN3 including pulses for turning on the gate circuit during the non-discharge control period.

The operation waveforms when the driving cycle is longer than the first cycle are similar to those in FIG. 8. That is, when the driving cycle is longer than the first cycle, mask control signals MN0 to MN3 that include pulses for turning on the gate circuit during the non-discharge control period, are generated. By turning on the gate circuit in each non-discharge control period, it is possible to prevent the voltage of the individual electrodes 83 from decreasing due to leakage current during the non-discharge control period, and it is possible to prevent an abnormal voltage (abnormal pulse) from being applied to the individual electrodes 83 at the start of the discharge control period.

On the other hand, by turning on the gate circuit in each non-discharge control period, the number of times the gate circuit is driven per time unit is increased. If the temperature of the recording head rises due to an increase in the number of times the gate circuit is driven, the ink viscosity may decrease and it may be difficult to perform the ink discharge control properly.

In FIG. 11, all mask control signals MN (MN0 to MN3) are maintained at a reference voltage to maintain the off state of the gate circuit of the analog switch 215 during the non-discharge control period. That is, the recording head control unit 116 holds waveform data for generating the mask control signals MN0 to MN3 that do not include pulses for turning on the gate circuit during the non-discharge control period.

The operation waveforms when the driving cycle is shorter than the first cycle, are similar to those in FIG. 7. That is, when the driving cycle is shorter than the first cycle, the mask control signals MN0 to MN3 that do not include pulses for turning on the gate circuit during the non-discharge control period, are generated.

If the gate circuit is not turned on during the non-discharge control period, the voltage of the individual electrode 83 of the piezoelectric element 70 is set to a reference voltage in a floating state, and, therefore, the voltage of the individual electrode 83 gradually decreases due to a leakage current. In this case, when a rectangular pulse of the mask control signal MN is applied to the gate circuit during the next discharge control period, the voltage of the individual electrodes 83 rises sharply to the reference voltage, which may cause an abnormal pulse to be generated. If an abnormal pulse is generated, ink may be erroneously discharged from the nozzle hole 62.

Figure 12:
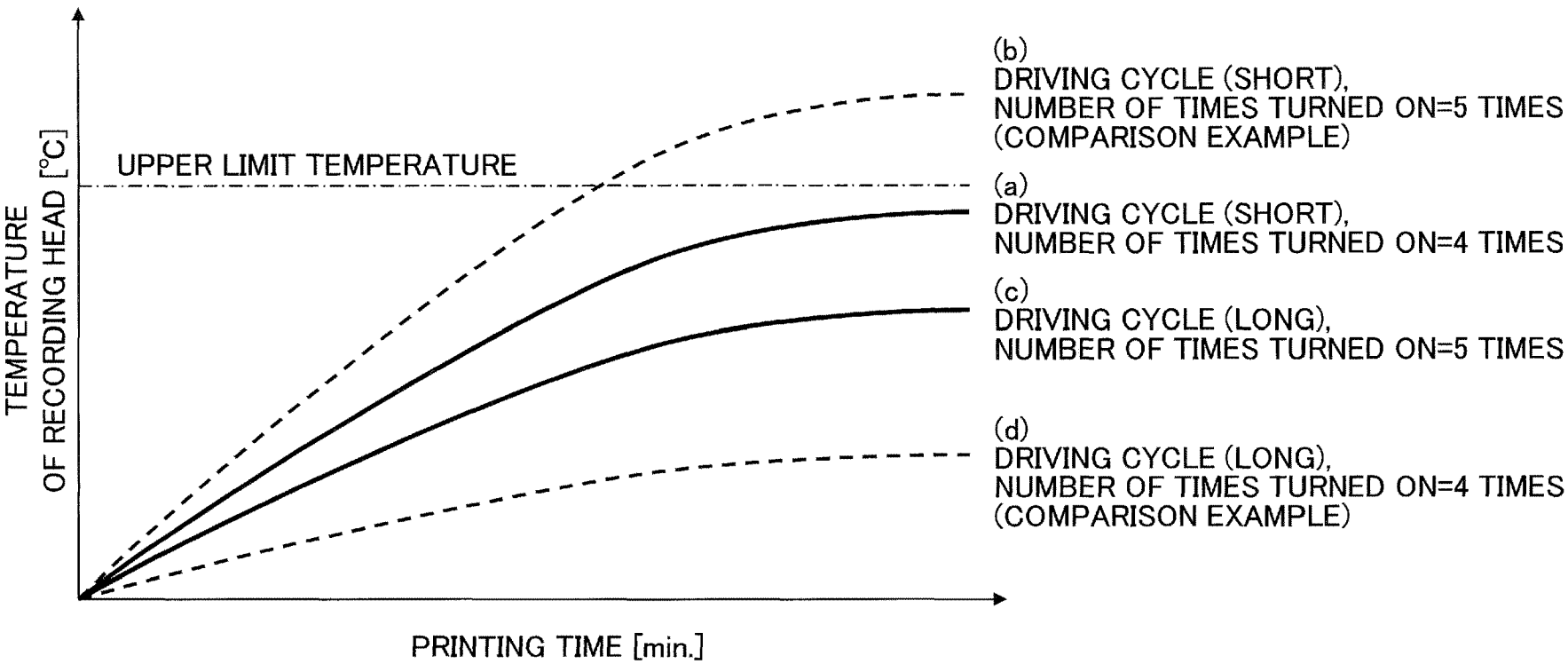
FIG. 12 is an explanatory diagram illustrating relationships between the printing time of an image forming apparatus including a liquid discharging apparatus and the temperature of a recording head (embodiment of the present invention and comparison examples)

FIG. 12 is an explanatory diagram illustrating a relationship between the printing time of the image forming apparatus including the liquid discharging apparatus and the temperature of the recording head. The temperature change in the present embodiment is indicated by a solid line, and the temperature change in a comparison example is indicated by a dashed line.

As described in FIG. 7, in the present embodiment, when the driving cycle is shorter than the first cycle, the gate circuit of the analog switch 215 is not turned on during the non-discharge control period, so the number of times the gate circuit is turned on in one driving cycle is, for example, four times ((a) in FIG. 12). On the other hand, as described in FIG. 10, when the driving cycle is shorter than the first cycle and the gate circuit of the analog switch 215 is turned on during the non-discharge control period, the number of times the gate circuit is turned on in one driving cycle is, for example, five times ((b) in FIG. 12).

When a printing operation, in which the number of times the gate circuit is turned on per time unit exceeds the predetermined number of times, continues for a long time, the temperature of the recording head control unit 116 may exceed the upper limit temperature. On the other hand, in the present embodiment, the number of times the gate circuit is turned on per time unit can be reduced compared to FIG. 10, and, therefore, it is possible to prevent the temperature of the recording head control unit 116 from exceeding the upper limit temperature.

Further, in the present embodiment, when the driving cycle is longer than the first cycle, the gate circuit of the analog switch 215 is turned on during the non-discharge control period, so that the number of times the gate circuit is turned on in one driving cycle is, for example, five times ((c) in FIG. 12). However, when the driving cycle is long, the number of times the gate circuit is turned on per time unit is less than that when the driving cycle is short, so that the temperature of the recording head control unit 116 does not exceed the upper limit temperature.

On the other hand, when the driving cycle is longer than the first cycle and the gate circuit of the analog switch 215 is not turned on during the non-discharge control period, the number of times the gate circuit is turned on in one driving cycle is, for example, four times ((d) in FIG. 12). When the driving cycle is long and the number of times the gate circuit is turned on in one driving cycle is small, the temperature of the recording head control unit 116 is unlikely to rise. However, during the non-discharge control period, the voltage of the individual electrode 83 of the piezoelectric element 70 drops due to leakage current, which may cause the failure described in FIG. 11.

Thus, in the embodiments described above, if the driving cycle is shorter than the first cycle, the gate circuit of the analog switch 215 is not turned on in the non-discharge control period, and, therefore, it is possible to prevent an increase in the number of times the gate circuit is turned on per time unit. Accordingly, it is possible to prevent the temperature of the gate circuit from rising excessively, and it is possible to prevent the temperature of the recording head 6 from rising. Accordingly, it is possible to prevent the temperature of the ink in the pressurizing liquid chamber 61 from exceeding the allowable temperature and to prevent the viscosity from falling below a predetermined value, and therefore the ink discharge control can be performed properly.

Further, if the driving cycle is longer than the first cycle, the gate circuit of the analog switch 215 is turned on in the non-discharge control period, and, therefore, it is possible to prevent the voltage of the individual electrode 83 of the piezoelectric element 70 from decreasing due to a leakage current. Accordingly, even when a rectangular pulse of the mask control signal MN is applied to the gate circuit during the discharge control period after the non-discharge control period, it is possible to prevent the voltage of the individual electrode 83 from sharply rising to the reference voltage. Accordingly, it is possible to prevent an abnormal voltage from being applied to the individual electrode 83, and it is possible to prevent ink from being erroneously discharged from the nozzle hole 62 due to an abnormal voltage.

As a result, it is possible to achieve both the inhibiting of voltage drop of the individual electrode 83 of the piezoelectric element 70 in the non-discharge control period and the preventing of the heat generation of the recording head 6. Further, a malfunction of the liquid discharging apparatus 400 can be prevented, and a decrease in the quality of printing on paper or the like by the image forming apparatus 40 can be prevented.

Figure 13:
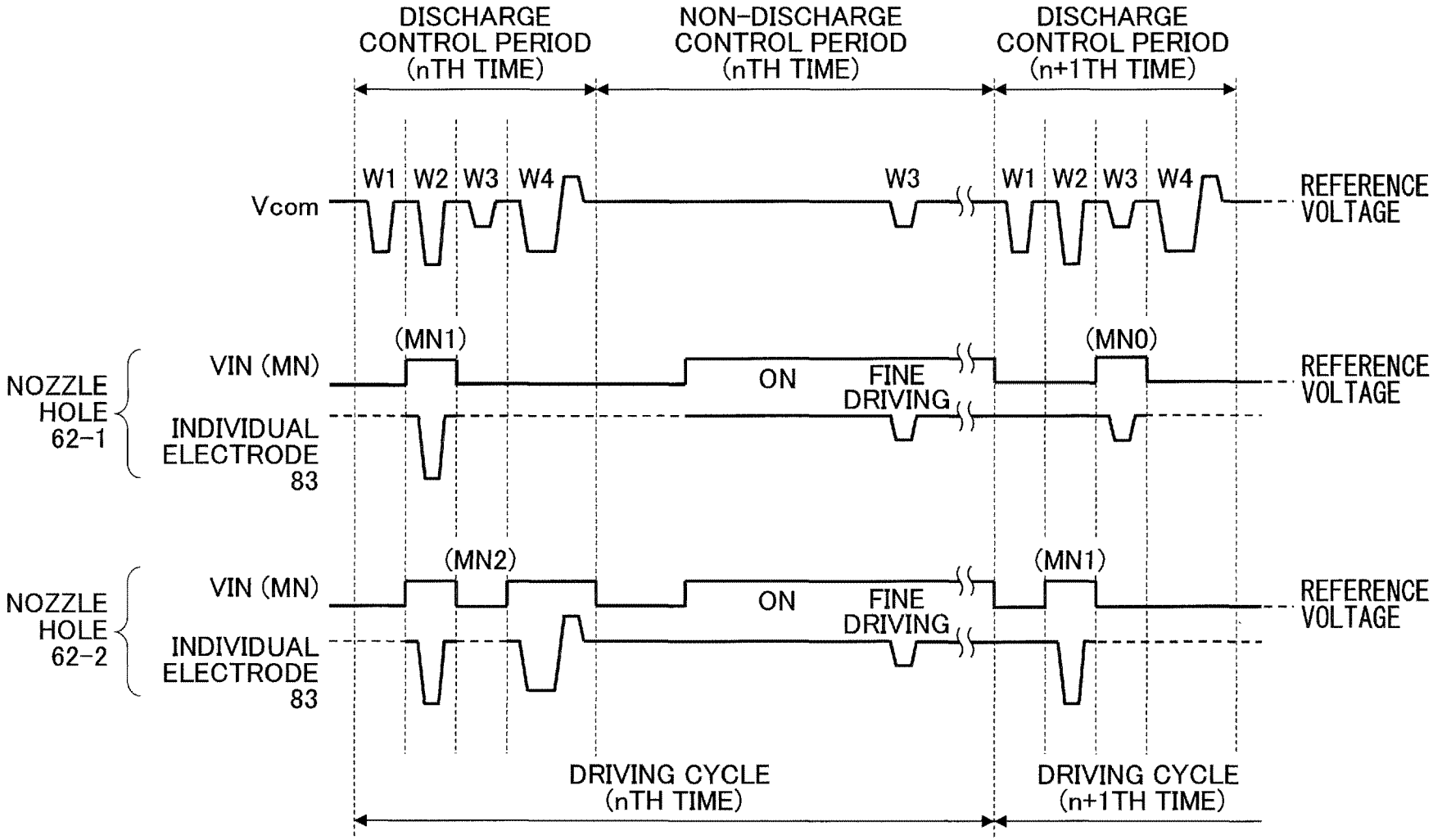
FIG. 13 is a waveform diagram illustrating an example of an operation of a liquid discharging apparatus according to another embodiment of the present invention.

FIG. 13 is a waveform diagram illustrating an example of the operation of a liquid discharging apparatus according to another embodiment. The same operations as in FIG. 8 will not be described in detail. The liquid discharging apparatus performing the operation illustrated in FIG. 13 is similar to the liquid discharging apparatus 400 illustrated in FIG. 4 except that the waveform of the common driving waveform signal Vcom output by the driving waveform generation circuit 107 is different. That is, the liquid discharging apparatus performing the operation illustrated in FIG. 13 is mounted in the image forming apparatus 40 illustrated in FIG. 2 and the image forming system 1 illustrated in FIG. 1.

FIG. 13 illustrates an operation waveform when the driving cycle is longer than the first cycle. The driving waveform generation circuit 107 generates the same waveform (fine driving waveform signal) as the waveform W3 selected by the mask control signal MN0 during the non-discharge control period. That is, the recording head control unit 116 applies a fine driving waveform signal to the individual electrode 83 during the voltage setting control in which a reference voltage is applied to the individual electrode 83 of the piezoelectric element 70 during the non-discharge control period. The number of waveforms W3 generated in the non-discharge control period is not limited to one, and may be plural.

The waveform of the mask control signal MN (MN0 to MN3) output by the recording head control unit 116 is the same as the embodiment described in FIGS. 1 to 9 and 12. Thus, during the non-discharge control period, a waveform (fine driving) that changes the pressure in the pressurizing liquid chamber 61 without discharging ink from the nozzle hole 62, is applied to the individual electrode 83 of the piezoelectric element 70. The fine driving waveform signal causes the meniscus surface of the nozzle hole 62 to vibrate, thereby preventing the ink from drying so that the viscosity of the ink is prevented from increasing.

When the driving cycle is shorter than the first cycle, the next discharge control period approaches before the waveform W3 of the non-discharge control period would appear, and, therefore, the operation waveform becomes the same as in FIG. 7.

As described above, in the embodiment illustrated in FIG. 13, as in the embodiments described above, it is possible to achieve both the inhibiting of the voltage drop of the individual electrode 83 of the piezoelectric element 70 during the non-discharge control period and the preventing of the heat generation of the recording head 6. Further, in the embodiment illustrated in FIG. 13, when the driving cycle is longer than the first cycle, by applying a fine driving waveform W3 to the individual electrode 83 of the piezoelectric element 70 during the non-discharge control period, the meniscus surface of the nozzle hole 62 can be vibrated to prevent the ink from drying so that the viscosity of the ink is prevented from increasing. As a result, it is possible to prevent a decrease in the quality of printing on the paper or the like by the image forming apparatus 40.

Figure 14:
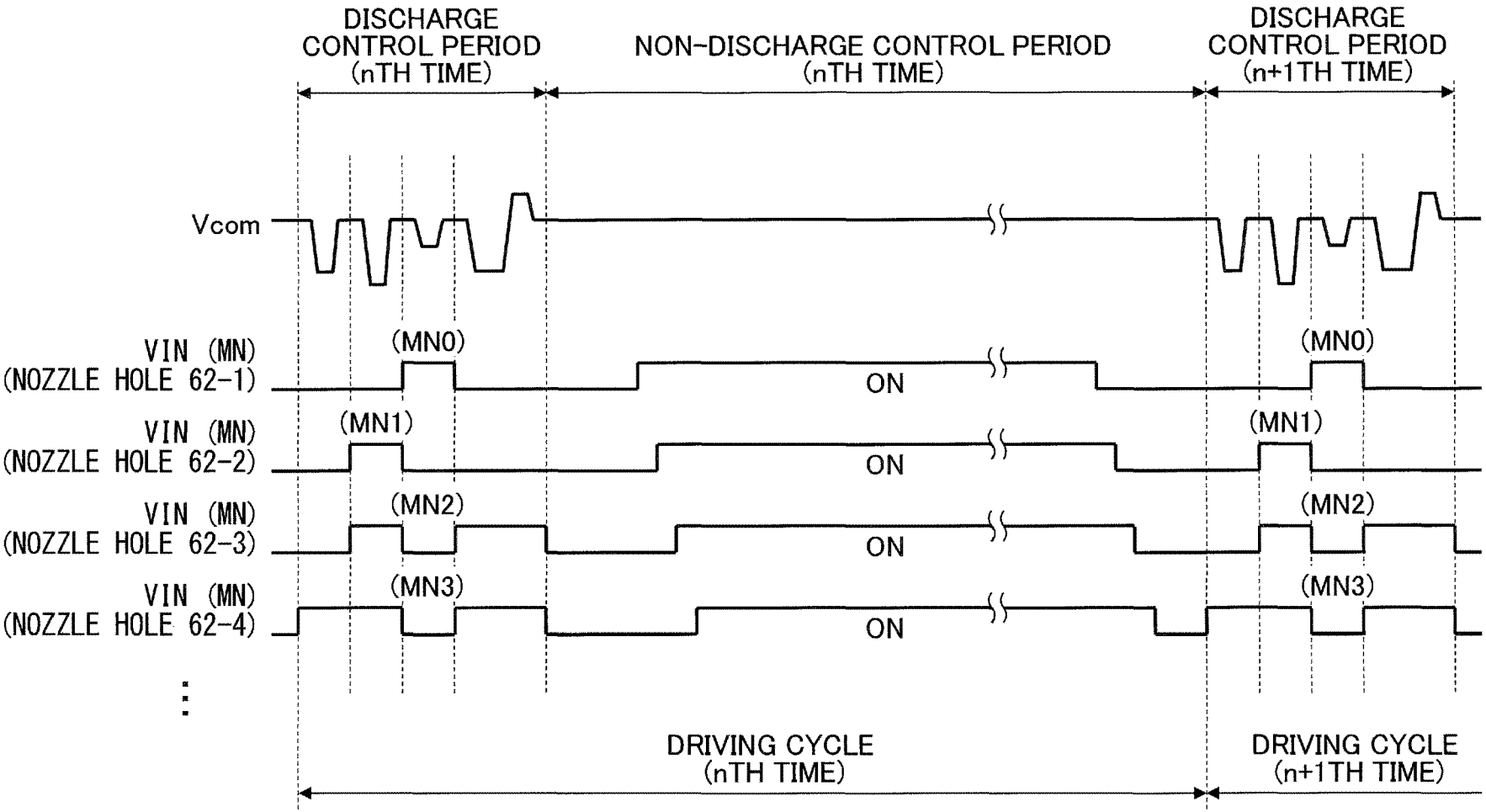
FIG. 14 is a waveform diagram illustrating an example of an operation of a liquid discharging apparatus according to another embodiment of the present invention.

FIG. 14 is a waveform diagram illustrating an example of the operation of the liquid discharging apparatus according to another embodiment. The same operation as in FIG. 8 will not be described in detail. The liquid discharging apparatus performing the operation illustrated in FIG. 14 is similar to the liquid discharging apparatus 400 illustrated in FIG. 4 except that the waveform of the mask control signal MN (MN0 to MN3) output by the recording head control unit 116 is different. That is, the liquid discharging apparatus that performs the operation illustrated in FIG. 14 is mounted in the image forming apparatus 40 illustrated in FIG. 2 and the image forming system 1 illustrated in FIG. 1.

FIG. 14 illustrates an operation waveform when the driving cycle is longer than the first cycle. The recording head control unit 116 generates mask control signals MN0 to MN3 (selection patterns) in which the respective high-level periods in the non-discharge control period are shifted from each other. That is, the timing of implementation of the voltage setting control differs for each of the mask control signals MN0 to MN3. The recording head control unit 116 holds waveform data for generating the waveforms of the mask control signals MN0 to MN3 in which the respective high-level periods in the non-discharge control are shifted from each other. Hereinafter, the high-level period of the mask control signal MN is also referred to as an on-period.

By shifting the on-periods of the mask control signals MN0 to MN3 in the non-discharge control period from each other, it is possible to prevent multiple gate circuits of the analog switch 215 from being turned on simultaneously, and to reduce the switching noise (power supply noise, etc.) generated by turning on the gate circuit. As a result, the malfunction of the liquid discharging apparatus 400 can be prevented, and the reliability of the image forming apparatus 40 and the image forming system 1 can be prevented from being decreased. By shifting the on-period in units of the mask control signals MN0 to MN3, the switching noise can be reduced without increasing the amount of waveform data held by the recording head control unit 116.

Note that the on-period of the non-discharge control period may be such that at least one mask control signal MN is shifted with respect to other mask control signals MN. For example, the on-period of the non-discharge control period may be shifted for each of two mask control signals MN. Further, the timing of turning off the mask control signal MN may not be shifted during the non-discharge control period.

As described above, in the embodiment illustrated in FIG. 14, as in the embodiments described above, it is possible to achieve both the inhibiting of the voltage drop of the individual electrode 83 of the piezoelectric element 70 during the non-discharge control period and the preventing of the heat generation of the recording head 6. Further, in the embodiment illustrated in FIG. 14, the switching noise of the analog switch 215 can be reduced by shifting the on-periods of the mask control signals MN0 to MN3 in the non-discharge control period from one another, thereby preventing malfunction of the liquid discharging apparatus 400. Further, by shifting the on-periods with respect to the mask control signals MN0 to MN3, the switching noise can be reduced without increasing the amount of waveform data held by the recording head control unit 116.

Figure 15:
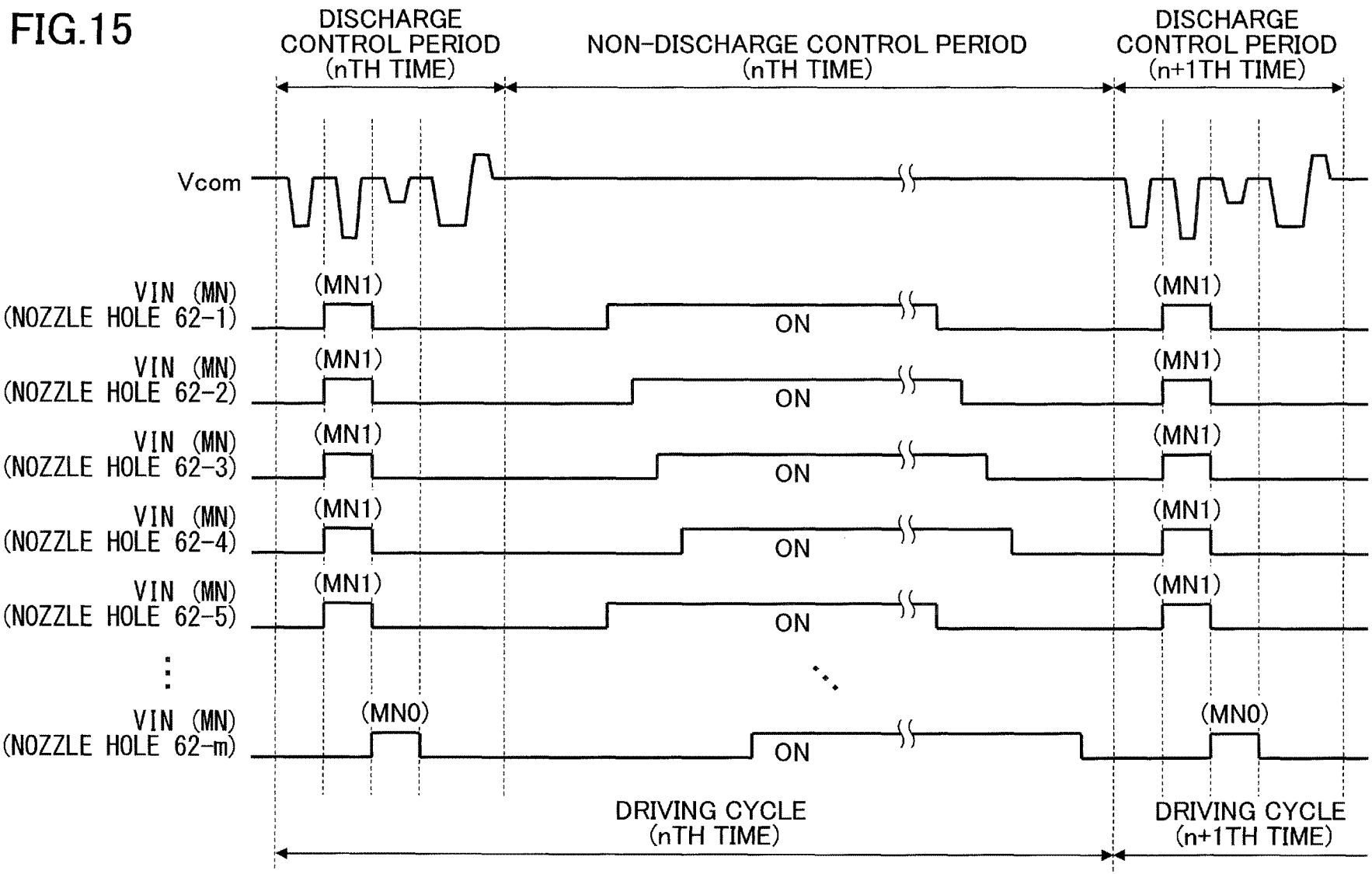
FIG. 15 is a waveform diagram illustrating an example of an operation of a liquid discharging apparatus according to another embodiment of the present invention.

FIG. 15 is a waveform diagram illustrating an example of the operation of the liquid discharging apparatus according to another embodiment. The same operations as in FIG. 8 will not be described in detail. The liquid discharging apparatus performing the operation illustrated in FIG. 15 is similar to the liquid discharging apparatus 400 illustrated in FIG. 4 except that the waveforms of the mask control signals MN (MN0 to MN3) output by the recording head control unit 116 are different. That is, the liquid discharging apparatus performing the operation illustrated in FIG. 15 is mounted in the image forming apparatus 40 illustrated in FIG. 2 and the image forming system 1 illustrated in FIG. 1.

FIG. 15 illustrates operation waveforms when the driving cycle is longer than the first cycle. For example, for each of the mask control signals MN0 to MN3, the recording head control unit 116 generates a plurality of waveforms in which the on-periods in the non-discharge control period are shifted from each other. That is, for each of the mask control signals MN0 to MN3, there is a plurality of timings of implementing the voltage setting control. The recording head control unit 116 holds data of a plurality of waveforms for generating waveforms in which the on-periods in the non-discharge control period are shifted from each other, for each of the mask control signals MN0 to MN3.

For example, for each of the mask control signals MN0 to MN3, the recording head control unit 116 holds a waveform data group including data of four waveforms in which the on-periods in the non-discharge control period are shifted from each other; i.e., there are four waveform data groups respectively corresponding to the mask control signals MN0 to MN3. For example, in the analog switch 215, the gate circuits are divided into four gate circuit groups, each including a predetermined number of gate circuits, and the four waveform data groups respectively correspond to the four gate circuit groups. The recording head control unit 116 outputs a waveform data group corresponding to one of the gate circuit groups, as a mask control signal MN.

In FIG. 15, the waveforms of the mask control signal MN1 are distinguished by the reference numeral of the nozzle hole 62 belonging to the same discharge block 90 as the corresponding piezoelectric element 70. For example, the piezoelectric elements 70 corresponding to the nozzle holes 62 are arranged in the recording head 6 in the order indicated by the branch numbers (−1, −2, etc.) of the nozzle holes 62. In the example of FIG. 15, the on-periods of the mask control signals MN1 corresponding to the piezoelectric elements 70 (the nozzle holes 62) adjacent to each other, are sequentially shifted.

In other words, the on-periods of the mask control signals MN1 applied to the gate circuits arranged adjacent to each other in the analog switch 215, are sequentially shifted. Accordingly, it is possible to reduce the possibility that mask control signals MN having the same on-timings will be supplied to gate circuits that are adjacent to each other, and this contributes to the reduction of switching noise in the gate circuits.

For example, the on-periods of the other mask control signals MN0, MN2, and MN3 may be the same as the on-periods of the mask control signal MN1, or the on-periods of all of the mask control signals MN0 to MN3 may be slightly shifted from each other. That is, with respect to the on-period of the non-discharge control period, it will suffice if the mask control signal MN corresponding to at least one piezoelectric element 70 is shifted with respect to the other mask control signals MN.

As described above, in the embodiment illustrated in FIG. 15, similar to the embodiments illustrated in FIGS. 1 to 9 and 12, it is possible to achieve both the inhibiting of the voltage drop of the individual electrode 83 of the piezoelectric element 70 during the non-discharge control period and the preventing of the heat generation of the recording head 6. Further, similar to the embodiment illustrated in FIG. 14, by shifting the on-periods of the mask control signals MN0 to MN3 from one another in the non-discharge control period, the switching noise of the analog switch 215 can be reduced.

Further, in the embodiment illustrated in FIG. 15, the number of waveforms (timings) in which the on-periods are shifted is greater than the number of mask control signals MN0 to MN3, thereby further reducing switching noise relative to the embodiment illustrated in FIG. 14.

According to one embodiment of the present invention, the heat generation of the recording head can be prevented while inhibiting a decrease in the voltage of the electrode of the piezoelectric element, during a non-discharge control period.

The liquid discharging apparatus and the image forming system are not limited to the specific embodiments described in the detailed description, and variations and modifications may be made without departing from the spirit and scope of the present invention.

What is claimed is:

1. A liquid discharging apparatus comprising:

a nozzle hole configured to discharge liquid;

a liquid chamber provided so as to communicate with the nozzle hole;

a piezoelectric element configured to change a pressure applied to the liquid in the liquid chamber to discharge the liquid from the nozzle hole;

a driving waveform generation circuit configured to generate a driving waveform signal during a discharge control period having a predetermined cycle, to apply a driving waveform voltage to the piezoelectric element;

a switch configured to selectively supply, to the piezoelectric element, at least one of a plurality of waveforms included in the driving waveform signal; and a controller configured to perform voltage setting control for applying a predetermined voltage to the piezoelectric element, in a case where a non-discharge control period, having a predetermined cycle, causes the piezoelectric element to change by a voltage that is greater than or equal to an allowable voltage, the non-discharge control period being a period during which the liquid is not discharged after the discharge control period, wherein an application timing of applying the predetermined voltage to the piezoelectric element when performing the voltage setting control, is set to occur a first time period or longer before a timing of causing the piezoelectric element to change by the voltage that is greater than or equal to the allowable voltage.

2. The liquid discharging apparatus according to claim 1, wherein the driving waveform generation circuit generates, at least once, a fine driving waveform signal for changing a pressure in the liquid chamber without discharging the liquid from the nozzle hole, during a period of performing the voltage setting control for applying the predetermined voltage to the piezoelectric element.

3. The liquid discharging apparatus according to claim 1, wherein the controller generates a plurality of selection patterns for applying the predetermined voltage to the piezoelectric element, and an application timing of applying the predetermined voltage to the piezoelectric element when performing the voltage setting control by at least one of the plurality of selection patterns, is different from an application timing of applying the predetermined voltage to the piezoelectric element when performing the voltage setting control by another one of the plurality of selection patterns.

4. The liquid discharging apparatus according to claim 3, further comprising:

a plurality of the nozzle holes; and a plurality of the piezoelectric elements corresponding to the plurality of the nozzle holes, wherein an application timing of applying the predetermined voltage to the piezoelectric element when performing the voltage setting control for at least one of the plurality of the piezoelectric elements, is different from an application timing of applying the predetermined voltage to the piezoelectric element when performing the voltage setting control for another one of the plurality of the piezoelectric elements.

5. The liquid discharging apparatus according to claim 4, wherein the plurality of selection patterns have a same pattern length, and application timings of respectively applying the predetermined voltage to the plurality of the piezoelectric elements are shifted from each other by a predetermined time.

6. A liquid discharging apparatus comprising:

a discharge block configured to discharge liquid, by a driving waveform voltage being applied to a piezoelectric element;

a driving waveform generation circuit configured to generate a driving waveform signal during a discharge control period having a predetermined cycle, and to generate a signal by which the liquid is not discharged from the discharge block during a non-discharge control period having a predetermined cycle, the non-discharge control period being a period after the discharge control period;

a selector configured to selectively supply, to the piezoelectric element, at least one of a plurality of waveforms included in the driving waveform signal; and a controller configured to perform voltage setting control for applying a predetermined voltage to the piezoelectric element, in a case where the non-discharge control period causes the piezoelectric element to change by a voltage that is greater than or equal to an allowable voltage, within a driving cycle corresponding to a sum of the discharge control period and the non-discharge control period, wherein an application timing of applying the predetermined voltage to the piezoelectric element when performing the voltage setting control, is set to occur a first time period or longer before a timing of causing the piezoelectric element to change by the voltage that is greater than or equal to the allowable voltage.

7. The liquid discharging apparatus according to claim 6, wherein the driving waveform generation circuit applies, to the piezoelectric element at least once, a fine driving waveform signal by which the liquid is not discharged from the discharge block, during a period of performing the voltage setting control for applying the predetermined voltage to the piezoelectric element.

8. The liquid discharging apparatus according to claim 6, wherein the controller generates a plurality of selection patterns for applying the predetermined voltage to the piezoelectric element, and an application timing of applying the predetermined voltage to the piezoelectric element when performing the voltage setting control by at least one of the plurality of selection patterns, is different from an application timing of applying the predetermined voltage to the piezoelectric element when performing the voltage setting control by another one of the plurality of selection patterns.

9. The liquid discharging apparatus according to claim 8, further comprising:

a plurality of the discharge blocks; and a plurality of the piezoelectric elements corresponding to the plurality of the discharge blocks, wherein an application timing of applying the predetermined voltage to the piezoelectric element when performing the voltage setting control for at least one of the plurality of the discharge blocks, is different from an application timing of applying the predetermined voltage to the piezoelectric element when performing the voltage setting control for another one of the plurality of the discharge blocks.

10. The liquid discharging apparatus according to claim 9, wherein the plurality of selection patterns have a same pattern length, and application timings of respectively applying the predetermined voltage to the plurality of the piezoelectric elements are shifted from each other by a predetermined time.

11. An image forming system comprising:

a recording head including a plurality of discharge blocks, each of the plurality of discharge blocks including a nozzle configured to discharge liquid in response to a driving waveform and an electrode configured to receive the driving waveform;

a driving waveform generator configured to provide the driving waveform in a discharge control period;

a switch connected to the driving waveform generator and the recording head, the switch being configured to selectively supply the driving waveform to the recording head; and a voltage controller connected to the driving waveform generator, the voltage controller being configured to apply a non-discharge waveform having a predetermined voltage to the recording head in a non-discharge control period, the non-discharge waveform causing the recoding head not to discharge the liquid in a case where the electrode receives a voltage being greater than or equal to an allowable voltage, wherein an application timing of applying the predetermined voltage to the piezoelectric element when performing the voltage setting control, is set to occur a first time period or longer before a timing of causing the piezoelectric element to change by the voltage that is greater than or equal to the allowable voltage.

12. The image forming system according to claim 11, wherein the non-discharge waveform includes a fine driving waveform signal for changing a pressure in the plurality of discharge blocks without discharging the liquid from the nozzle.

13. The image forming system according to claim 11, wherein the voltage controller generates a plurality of selection patterns of waveforms for applying the predetermined voltage to the electrodes, and one of the plurality of selection patterns of the waveforms is different from another one of the plurality of selection patterns of the waveforms.

14. The image forming system according to claim 13, wherein the plurality of selection patterns of the waveforms have a same pattern length, and application timings of the respective waveforms are shifted from each other.

* * * * *